US011111113B2

(12) United States Patent
Martinsen

(10) Patent No.: US 11,111,113 B2
(45) Date of Patent: Sep. 7, 2021

(54) MOBILE PASSIVE AND ACTIVE HEAVE COMPENSATOR

(71) Applicant: Safelink AS, Porsgrunn (NO)

(72) Inventor: Tord B Martinsen, Porsgrunn (NO)

(73) Assignee: SAFELINK AS, Porsgrunn (NO)

( * ) Notice: Subject to any disclaimer, the term of this patent is extended or adjusted under 35 U.S.C. 154(b) by 207 days.

(21) Appl. No.: 16/079,038

(22) PCT Filed: Feb. 22, 2017

(86) PCT No.: PCT/NO2017/050049

§ 371 (c)(1),
(2) Date: Aug. 22, 2018

(87) PCT Pub. No.: WO2017/146591

PCT Pub. Date: Aug. 31, 2017

(65) Prior Publication Data

US 2019/0047830 A1 Feb. 14, 2019

(30) Foreign Application Priority Data

Feb. 22, 2016 (NO) ..... 20160301
May 8, 2016 (NO) ..... 20160771
(Continued)

(51) Int. Cl.
*B66C 13/02* (2006.01)
*B66C 13/04* (2006.01)
*B66C 23/52* (2006.01)

(52) U.S. Cl.
CPC ..... *B66C 13/02* (2013.01); *B66C 13/04* (2013.01); *B66C 23/52* (2013.01)

(58) Field of Classification Search
CPC ..... B66C 13/02; B66C 13/04; B66C 23/52
See application file for complete search history.

(56) References Cited

U.S. PATENT DOCUMENTS 3,912,227 A 10/1975 Meeker et al.
3,946,559 A 3/1976 Stevenson
(Continued)

FOREIGN PATENT DOCUMENTS

DE 102014215313 A1 2/2016
EP 2896589 A1 7/2015
(Continued)

OTHER PUBLICATIONS

Supplementary European Search Report, Application No. EP 17 75 6897, Date of Completion of the Search: Sep. 16, 2019.
(Continued)

*Primary Examiner* — Michael E Gallion
(74) *Attorney, Agent, or Firm* — Flener IP & Business Law; Zareefa B. Flener

(57) ABSTRACT

The publication describes a mobile active heave compensator provided with an attachment device for suspending the compensator from a load bearing device and an attachment device for carrying a payload. The compensator comprises a passive heave compensation part and an active heave compensation part and is associated with a sensor arrangement producing input signals for a control unit and a power source. The compensator incorporates a hydraulic fluid pump and/or motor device, affecting the active heave compensating part, producing output signal(s) to the hydraulic fluid and/or motor device to transport the hydraulic fluid as required, based on input signals received from the sensor arrangement.

27 Claims, 15 Drawing Sheets

(30) Foreign Application Priority Data

| | | |
|---|---|---|
| Jun. 21, 2016 | (NO) | 20161040 |
| Jun. 27, 2016 | (NO) | 20161247 |
| Jun. 30, 2016 | (NO) | 20161090 |

(56) References Cited

U.S. PATENT DOCUMENTS

| | | | | |
|---|---|---|---|---|
| 4,121,806 | A | 10/1978 | Iato et al. | |
| 4,351,261 | A | 9/1982 | Shanks | |
| 4,501,219 | A | 2/1985 | Bates, Jr. | |
| 4,724,970 | A | 2/1988 | Kuehn | |
| 4,964,491 | A | 10/1990 | Dombrowski | |
| 5,209,302 | A * | 5/1993 | Robichaux | E21B 19/09 166/355 |
| 9,718,653 | B2 * | 8/2017 | Bergem | B66C 23/53 |
| 2005/0179021 | A1 * | 8/2005 | Selcer | B66C 13/02 254/275 |
| 2006/0016605 | A1 | 1/2006 | Coles | |
| 2008/0251980 | A1 | 10/2008 | Ormond | |
| 2010/0050917 | A1 * | 3/2010 | von der Ohe | B63B 39/00 114/122 |
| 2012/0031622 | A1 | 2/2012 | Carlsen et al. | |
| 2016/0083228 | A1 * | 3/2016 | Holck | B66C 13/06 414/138.2 |
| 2018/0370775 | A1 * | 12/2018 | Gong | F15B 1/02 |
| 2019/0047829 | A1 * | 2/2019 | Martinsen | B66C 13/04 |
| 2019/0145191 | A1 * | 5/2019 | Martinsen | E21B 19/006 91/4 R |
| 2019/0292023 | A1 * | 9/2019 | Martinsen | B66C 13/02 |
| 2020/0039615 | A1 * | 2/2020 | Kristjansson | E21B 19/006 |

FOREIGN PATENT DOCUMENTS

| | | | |
|---|---|---|---|
| EP | 2982638 | A1 | 2/2016 |
| GB | 2485570 | A | 5/2012 |
| NO | 20140672 | A | 12/2015 |
| WO | 2012161565 | A1 | 11/2012 |
| WO | 2015038004 | A1 | 3/2015 |

OTHER PUBLICATIONS

Patent Cooperation Treaty, PCT International Search Report, PCT/NO2017/050049, Safelink AS.
Norwegian Search Report, Patent Varemerke Design, Patentsøknads nr. 20160771.
Norwegian Search Report, Patent Varemerke Design, Patentsøknads nr. 20161040.
Norwegian Search Report, Patent Varemerke Design, Patentsøknads nr. 20161090.
Norwegian Search Report, Patent Varemerke Design, Patentsøknads nr. 2016301.
Norwegian Search Report, Patent Varemerke Design, Patentsøknads nr. 20161247.

* cited by examiner

MOBILE PASSIVE AND ACTIVE HEAVE COMPENSATOR

THE TECHNICAL FIELD OF THE INVENTION

Mobile active heave compensator provided with an attachment device for suspending the compensator from a load bearing device and an attachment device for carrying a payload, comprises a passive heave compensation part and an active heave compensation part, and being associated with a sensor arrangement producing input signals for a control unit and a power source.

BACKGROUND FOR THE INVENTION

The following prior art patents and articles relate to heave compensators of various types:

"*Subsea Heave Compensators*", 2009 paper by Bob Wilde and Jake Ormond. The paper describes use of valves to increase and decrease gas pressure in a heave compensator. Gas release to surroundings is also described.

NO 20140672—Self adjusting heave compensator. Describes how a position sensor can be used to control the equilibrium position of a heave compensator piston by adjusting gas pressure up or down by use of valves between tanks with a differential pressure that allows flow (i.e. increase pressure by injecting gas from a high-pressure tank into the main accumulator and reduce pressure by releasing gas from the main accumulator into a tank with lower pressure).

U.S. Pat. No. 4,724,970 A—Compensating device for a crane hook. The compensation design shown has hydraulic fluid on both sides of the actuator piston connected to gas accumulators.

US 2008/251980 A1—Depth compensated subsea passive heave compensator. The compensation design shown has hydraulic fluid on both sides of the actuator piston connected to a gas accumulator and a depth compensation cylinder.

Many prior art active heave compensators exist, like the one described in e.g. US 2010/0057279 A1.

One disadvantage with the prior art solution is that traditional active compensators often do not have a passive backup system and always stay topside on an installation vessel.

Another major disadvantages of the prior art solutions are: high capital binding in permanent installed (i.e. not mobile) equipment which is often only needed a few weeks per year, high installation costs, high maintenance costs (especially related to fatigue in steel wire rope), poor splash zone crossing performance due to fast dynamics, poor performance for short wave periods due to fast dynamics, poor resonance protection, high power demand and lack of models for heavy lifts.

SUMMARY OF THE INVENTION

In the following through out the specification the following terms means:

By "mobile compensator" is meant a heave compensator in the sense of an independent, separate unit that is not made as an integrated part of a crane or a lifting unit, but may be transported between different lifting vessels if and when required, intended to be temporarily suspended from a lifting device.

An active heave compensation part is an element connected together with a passive motion compensation system in order to: i) significantly reduce the tension variation/ spring force in the passive system; ii) to obtain a constant tension during the heave period; and iii) manipulating the total system, both passive and active together in order to obtain a close to exact cylinder stroke based on a motion reference unit, i.e. for smooth landing of equipment on a surface, for example either on a seabed or on another body.

The term "cylinder" used in this specification means a closed body with an inner enclosed volume, configured to withstand the required internal and/or external pressure and being provided with a fluid inlet and/or fluid outlet.

The term "vacuum" means a pressure less than two bar.

The term "device for hydraulic fluid transportation" can represent hydraulic pumps in series or parallel and includes all valves and sensors needed for operation.

The term "device for gas transportation" can represent a gas compressor or gas booster driven by either hydraulics or compressed air.

The term "conduit device" can represent tubing, piping, or manifolds with internal channels connecting one or more volumes, valves, pumps or other equipment.

The term "pressure intensifier" is a hydraulic machine for transforming hydraulic power at low pressure into a reduced volume at higher pressure.

The term "double acting pressure intensifier" means a hydraulic machine for transforming hydraulic power at low pressure into a reduced volume at higher pressure, but with a higher efficiency than a single acting intensifier.

The term "depth compensator" means a device suitable to compensate for external water pressure acting on the actuator piston rod.

The term "energy source" means an energy source that powers the compensator, including the device for hydraulic fluid transportation, and may be a large battery pack or an umbilical.

An mobile heave compensator is a mobile compensation device, intended to be connected between the crane hook and a payload, where the compensator is suitable to reduce dynamic force and motion acting on the payload as well as dynamic force acting on the crane.

Tanks may be connected to any volume to increase its size.

It is often possible to replace a fluid type with another one and still maintain functionality Oil means any liquid (e.g. glycol water mix).

Most components can be connected in parallel to increase its size or capacity.

The main object of the present invention is to provide a mobile heave compensator that is capable of active position/speed control of the actuator while still being mobile, i.e. a loose lifting gear, and not needing an external energy source.

Another object of the present invention is to provide a transportable active heave compensator that is self-supported, able to function if required, without the need for external connections to an external energy source or high pressure unit during operation a lifting operation.

Another object of the present invention is to provide a mobile heave compensator that eliminates, or at least substantially reduces wear and tear of a crane wire rope and a crane system used for offshore heavy lifts from a floating installation on to a sea bed installation or to a fixed or floating unit, such as a barge.

Another object of the present invention is to provide an mobile heave compensator with enhanced performance, increasing the availability and operational weather window, i.e. allowing crane vessel to operate in rougher seas without increasing the hazard correspondingly.

Yet another object of the present invention is to provide a mobile heave compensator that is more cost effective and more reliable, reducing the downtime of the crane vessel.

An even further object of the present invention is to provide a mobile heave compensator elimination the relative wave induced movement between the payload and an installation unit, either on the sea bed or on a barge.

Yet another object of the present invention is to provide a mobile heave compensator with reduced weight without reducing the performance or the capacity of the heave compensator and/or providing enhanced precision when landing the payload.

Another object of the present invention is to provide a mobile heave compensator possibly with incorporated a system or arrangement for compensation of depth, temperature, weight inaccuracy, and buoyancy.

The objects are achieved by means of the mobile heave compensator as described in the independent claims, while embodiments, alternative compensators and variants are defined by the independent claims.

According to the invention it is provided a mobile active heave compensator provided with an attachment device for suspending the compensator from a load bearing device and an attachment device for carrying a payload, comprises a passive heave compensation part and an active heave compensation part, and being associated with a sensor arrangement producing input signals for a control unit and a power source. The compensator incorporates a hydraulic fluid pump and/or motor device, affecting the active heave compensating part, producing output signal(s) to the hydraulic fluid and/or motor device, based on input signals received from the sensor arrangement.

According to one embodiment the mobile active heave compensator may be provided with a power source and/or the control unit forming an integral part of the compensator.

Moreover, the mobile heave compensator may be self supported without the need for any external electric or fluid connection to a surface vessel or connection to an externally arranged high pressure unit during lifting operations. The compensator may further comprise at least an actuator and an accumulator and that the hydraulic fluid transportation device affects directly or indirectly pressures appearing in the actuator and/or accumulator and may be provided with a conduit system including a by-pass line, enabling by-passing the pump and/or motor operating in a passive modus.

According to a further embodiment of the invention, it is provided an in-line heave compensator, comprising an actuator provided with a first cylinder and a reciprocating piston movably arranged inside the cylinder and with a piston rod extending through an end wall of the cylinder, the piston dividing the cylinder into an enclosed first volume on one side of the piston, and a second enclosed volume on the opposite side. The ends of the actuator are provided with a connection device. At least one accumulator in the form of a cylinder provided with an internally arranged reciprocating piston is provided, configured to move inside the accumulator, dividing the accumulator into a third enclosed volume on one side of the piston and a fourth enclosed volume on the opposite side; and fluid communicating line system extending between the actuator and the at least one cylinder. The mobile heave compensator is provided with a device for hydraulic fluid transportation affecting a pressure in one of the actuator volumes or one of the volumes in accumulator.

According to one embodiment the device for hydraulic fluid transportation communicates hydraulic fluid between an enclosed volume on one side of the actuator piston and an enclosed volume on one side of the piston in another cylinder, directly or indirectly is affecting the pressure in one of the volumes.

Moreover, the heave compensator may be provided a first and a second sensing device for controlling the hydraulic fluid communicated by the device for hydraulic fluid transportation.

According to a further embodiment one of the sensors used may be chosen from the group of an internal accelerometer, water pressure measuring device, or a device for measuring the difference on position between the compensator and the payload.

The actuator and/or the accumulator may be provided with one additional separated volume in addition to the previously mentioned two volumes.

Further, the accumulator being a double acting gas accumulator with a reciprocating piston, provided with a fourth separated volume, the piston being provided with two piston rods, configured to run with their ends in two of the four separated volumes.

One embodiment of the invention is a mobile active heave compensator that basically is a passive heave compensator, which traditionally is a mobile tool, with an added active component to increase the performance, which is controlled based on measurements performed by sensors. The energy source for the compensator can be either integrated into the compensator (e.g. a battery pack) or on the vessel connected to the compensator via an umbilical.

According to the independent claim the invention a mobile active heave compensator/MAHC comprises: a passive compensation device), adapted for linear reciprocating motion, sensor device, adapted for giving an output signal to an active element, based on payload motion and/or crane hook motion and/or vessel motion and/or crane tip motion, an active element, adapted for manipulating the linear reciprocating motion in such a way that the motion of the payload relative to the seabed is minimized when desired, characterized by that the mobile active heave compensator is connected between the crane hook and the payload.

The main features of the present invention are given in the independent claim is provided. Additional features of the invention are given in the dependent claims.

According to another embodiment a mobile active heave compensator can basically be a kind of a passive heave compensator, which traditionally is a mobile inline tool, with an added active component to increase the performance. The energy source for the compensator can be either a large battery pack or an energy source on the vessel connected to the compensator via an umbilical.

According to one embodiment of the invention a mobile active heave compensator/IAHC comprises: a first cylinder having an upper end and a lower end; a first connection device mounted at the upper end of the first cylinder and adapted for connecting the first cylinder to at least one of: a vessel at sea surface and a payload; a first piston located within the first cylinder and adapted for reciprocation with respect thereto; a first piston rod connected to the first piston and extending downwardly therefrom through the lower end of the first cylinder; a second connector device adapted for securing the first piston rod at least one of: the vessel at the sea surface and the payload, and located at the lower end of the first cylinder. There is a first volume of hydraulic fluid located between the first piston and the lower end of the first cylinder. There is a second volume of hydraulic fluid located between the first piston and the upper end of the first cylinder. The compensator further comprises a second cylinder containing a second piston. There is a third volume of hydraulic fluid located between the lower end of the second cylinder and the second piston. The compensator further comprises a third cylinder containing a third piston. There is a fourth volume of hydraulic fluid located between the third piston and the upper end of the third cylinder. A device for hydraulic fluid transportation is adapted for transporting hydraulic fluid between the second volume of hydraulic fluid in the first cylinder and the fourth volume of hydraulic fluid in the third cylinder. The hydraulic fluid is transported between the second volume of hydraulic fluid in the first cylinder and the device for hydraulic fluid transportation via a sixth conduit device connected to the upper side of the first cylinder. The hydraulic fluid is transported between the fourth volume of hydraulic fluid in the third cylinder and the device for hydraulic fluid transportation via a fifth conduit device connected to the upper side of the third cylinder. The hydraulic fluid is transported between the first volume of hydraulic fluid located at the lower side of the first cylinder and the third volume of hydraulic fluid located at lower side of the second cylinder via a first conduit device connecting the lower sides of the first and the second cylinder. A sensing arrangement is adapted for direct or indirect measuring an equilibrium position of at least one of: the first piston and the first piston rod, relative to at least one of: the lower and upper ends of the first cylinder. The device for hydraulic fluid transportation is controlled based on the direct or indirect measurements from the sensing arrangement.

Furthermore, there is a first volume of gas located between the upper end of the second cylinder and the second piston. Thus, the gas pressure in the first gas volume in the second cylinder effectively pressurizes the first hydraulic fluid volume in the first cylinder via the first conduit device, as well as the third hydraulic fluid volume in the second cylinder. There is also a third gas volume located between the third piston and the lower end of the third cylinder. Thus, the gas pressure in the third gas volume in the third cylinder effectively pressurizes the fourth hydraulic fluid volume in the third cylinder.

The compensator further comprises a fourth cylinder and a fifth cylinder. There is a second gas volume located in the fourth cylinder. There is also a fourth gas volume located in the fifth cylinder. A device for gas transportation is adapted for transporting gas between any combination of: the first gas volume, the second gas volume, the third gas volume and the fourth gas volume, where the device for gas transportation is adapted to expel gas to the surroundings from any of: the first gas volume, the second gas volume, the third gas volume and the fourth gas volume. A second conduit device is adapted for transporting gas between the first gas volume in the second cylinder and the device for gas transportation. A third conduit device is adapted for transporting gas between the second gas volume in the fourth cylinder and the device for gas transportation. A fourth conduit device is adapted for transporting gas between the third gas volume in the third cylinder and the device for gas transportation. A ninth conduit device is adapted for transporting gas between the fourth gas volume in the fifth cylinder and the device of gas transportation. A valve can be used to separate the first gas volume in the second cylinder and the fourth gas volume in the fifth cylinder. An eighth conduit device is adapted for transporting gas between the first gas volume in the second cylinder and the valve. A seventh conduit device is adapted for transporting gas between the fourth gas volume in the fifth cylinder and the valve.

A further alternative of the invention is a mobile depth compensated active heave compensator that basically can be a kind of a passive heave compensator, which traditionally is an inline tool, with an added active component to increase the performance. The energy source for the compensator can be either a battery pack or an energy source on the vessel connected to the compensator via an umbilical. The ideas presented in this application is based on an earlier application, "Inline active heave compensator", which has more details on adjustment of gas pressure, which is not presented here, but can of course be implemented for the compensator designs shown in the current application as well (for all volumes containing gas).

According to the invention a depth compensated mobile active heave compensator comprises: a first cylinder having an upper end and a lower end, a first connection device mounted at the upper end of the first cylinder and adapted for connecting the first cylinder to at least one of: a vessel at sea surface or a payload, a first piston located within the first cylinder and adapted for reciprocation with respect thereto, a first piston rod connected to the first piston and extending downwardly therefrom through the lower end of the first cylinder, a second connector device adapted for securing the first piston rod to at least one of: a vessel at the sea surface or a payload, and located at the lower end of the first cylinder, a first volume of hydraulic fluid located between the first piston and the lower end of the first cylinder, a second volume of hydraulic fluid located between the first piston and the upper end of the first cylinder, a second cylinder containing a second piston, a third volume, containing hydraulic fluid, located between the lower end of the second cylinder and the second piston, a fourth volume, containing gas, located between the upper end of the second cylinder and the second piston, effectively pressurizing the third volume and the first volume via conduit device, a sensor, adapted for directly or indirectly measuring movement of the mobile depth compensated active heave compensator, a position sensor, adapted for measuring the position of a piston, a device for fluid transportation adapted for applying fluid pressure to the second volume, where the device for fluid transportation is controlled based on sensor measurements, a device for depth compensation, by increasing the pressure in the second volume, where the pressure increase is proportional to the external pressure.

The invention also includes as an embodiment an Active Heave Compensator (AHC). The AHC consists of a hydraulic actuator connected to one or more advanced gas accumulators, which further is connected to one or more gas tanks. The advanced gas accumulator allows for very efficient use of commercially available hydraulic pumps that are used to gain actively control the hydraulic actuator. Further, the AHC has two different ways to compensate for external water pressure, a compact and efficient passive system and an active system. Other influences like temperature variations and load variations are also handled by the active compensation system, which is able to increase or reduce gas pressure in tanks and accumulators individually by use of control valves and gas boosters. Automatic control of the hydraulic actuator is used to compensate for heave motion. The automatic control is controlled by a computer that calculates the control signal based on measurements from several sensors, where the most important ones are the piston position sensor, the accelerometer and the wire rope speed sensor. Information about the wire rope speed is transferred to the compensator with wireless signals while the compensator is in air and with acoustic transmission while it is submerged. The compensator can operate in several different modes with variable stiffness and damping with or without active control of the hydraulic actuator and with or without active control of the pressure levels in the various gas volumes. The compensator is energy efficient due to the fact that passive part of the compensator carries the entire load of the payload weight and the actively controlled hydraulic pumps only have to compensate for gas compression effects and friction, which typically is about 15% of the force compared to static force. Energy regeneration is also used so that only friction and oil leakage and mechanical losses in the hydraulic pump contributes to the energy consumption. For AHC units with active depth compensation the power consumption is further lowered due to reduced friction at deep waters. Further, acoustic communication subsea and wireless communication topside allows for control and monitoring of the compensator, on-board sensors allows the user to verify performance after a lift is concluded.

The invention has the following advantages compared to the prior art; mobile construction, lower cost for same capacity, as good performance for long wave periods and better performance for short wave periods, excellent splash zone crossing performance, well-suited for resonance protection, reduced wear of the steel wire rope, low energy consumption.

The main features of this patent application, which is not covered in detail by previous applications:

- The use of a double acting gas accumulator, which utilizes normal hydraulic pumps at a much higher level than prior art (as the pump can apply full pressure in two directions at relatively low flow rates) and removes the need for large dedicated accumulators.
- The depth compensator, which is much more compact and light than prior art (can typically use one small depth compensator, compared to usually two large ones for prior art)
- Use of acoustic communication with the vessel to reduce lag in crane operator commands.

The invention has the following advantages compared to the prior art, lower cost for same capacity, as good performance for long wave periods and better performance for short wave periods, excellent splash zone crossing performance, well-suited for resonance protection, reduced wear of the steel wire rope, low energy consumption. However, the compensator uses some of the available lifting height, and it is required to pre-set the compensator before usage. Furthermore, when using a battery pack for the compensator, there could be some limited usable compensation time per lift.

The invention has the following advantages compared to the prior art; lower cost for same capacity, as good performance for long wave periods and better performance for short wave periods, excellent splash zone crossing performance, well-suited for resonance protection, reduced wear of the steel wire rope, low energy consumption. However, the compensator uses some of the available lifting height, and it is required to pre-set the compensator before usage. Furthermore, when using a battery pack for the compensator, there could be some limited usable compensation time per lift.

BRIEF DESCRIPTION OF THE DRAWINGS

Embodiments according to the invention shall be disclosed in more detail in the following description below, referring to the attached drawings wherein.

DETAILED DESCRIPTION OF THE EMBODIMENTS DISCLOSED IN THE DRAWINGS

The following description of exemplified embodiments refers to the accompanying drawings. The same reference numbers in different drawings identify the same or similar elements. The following detailed description does not limit the invention. Instead, the scope of the invention is defined by the appended claims. The following embodiments are discussed, for simplicity with regards to the terminology and structure of a compact mobile heave compensator showing ion principle the relation between the various elements being integrated in the compensator, but not showing the physically assembled product. Moreover, the various elements forming the mobile active heave compensator are only schematically shown.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, particular features, structures, or characteristics may be combined in any suitable manner in one or more embodiments.

It should be noted that the various hydraulic cylinder types shown in FIGS. 3A-3L may be used in various embodiments and/or constellations according to the present invention without deviated from the inventive concept.

Figure 1:
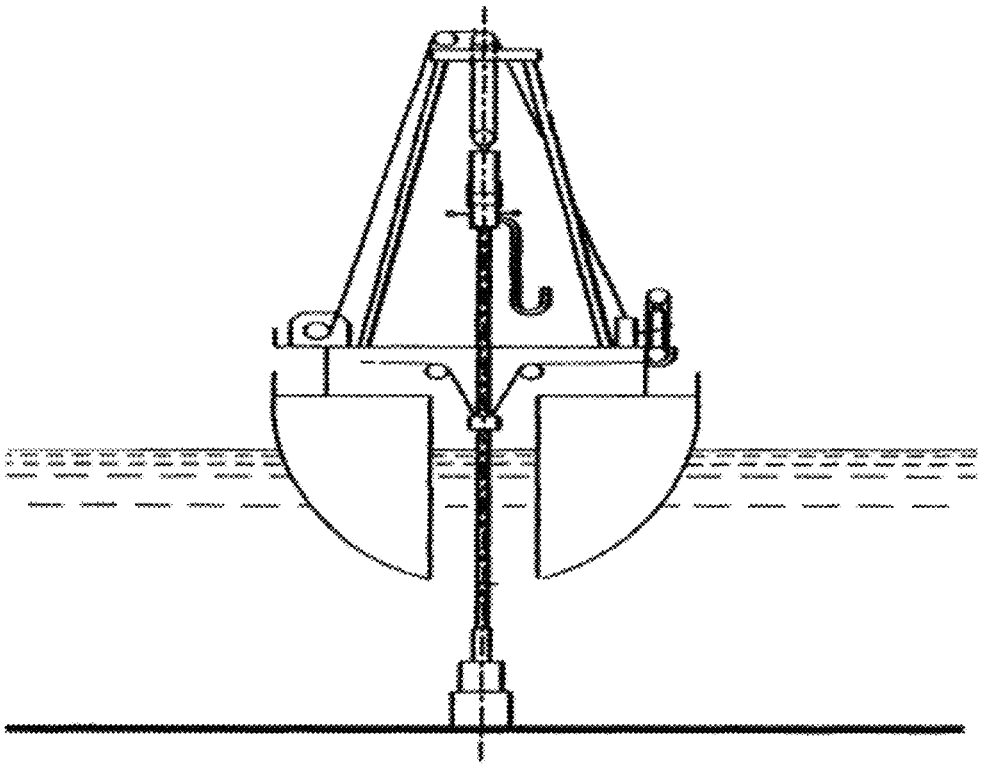
Fig. 1 (Prior Art)
FIG. 1 shows schematically a general view of a prior art solution of an active heave compensator, permanently installed on a topside onboard a floating vessel.

FIG. 1 shows schematically a general view of a prior art solution of an active heave compensator, permanently installed on a topside onboard a floating drilling or workover vessel, the riser being a stationary unit extending from above the sea level down to the seabed, while the motion of the surface vessel caused by wave action is taken by a heave compensator forming an integral part of the rig.

Figure 2:
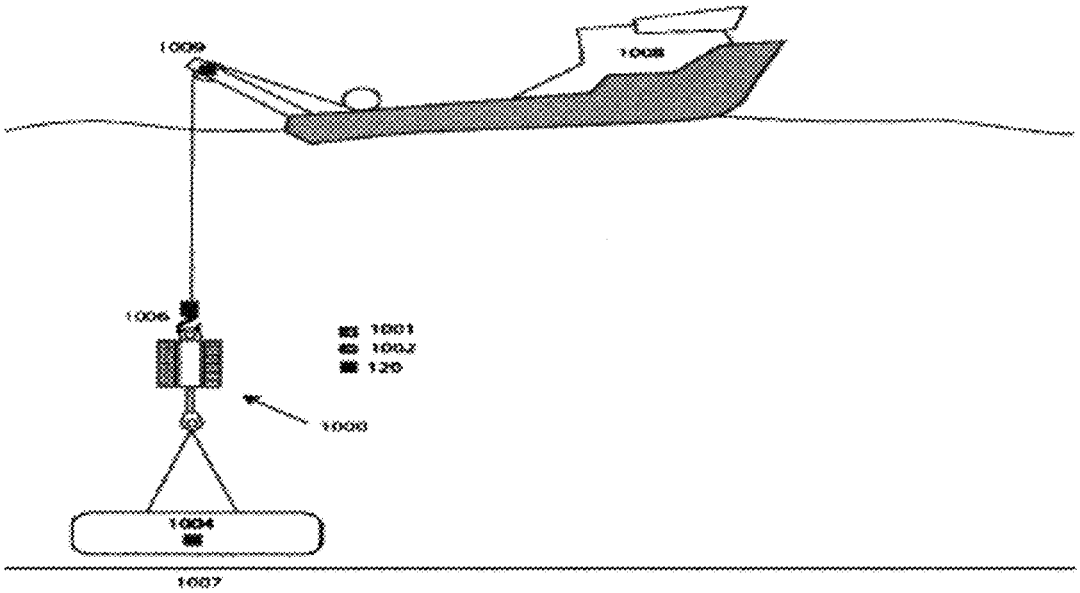
FIG. 2 shows schematically a view of vessel provided with a mobile active heave compensator arranged in-line, the compensator also provided with sensors and an active element.
Figures 3A, 3B, 3C, 3D, 3E, 3F, 3G, 3H, 3I, 3J, 3K, 3L:
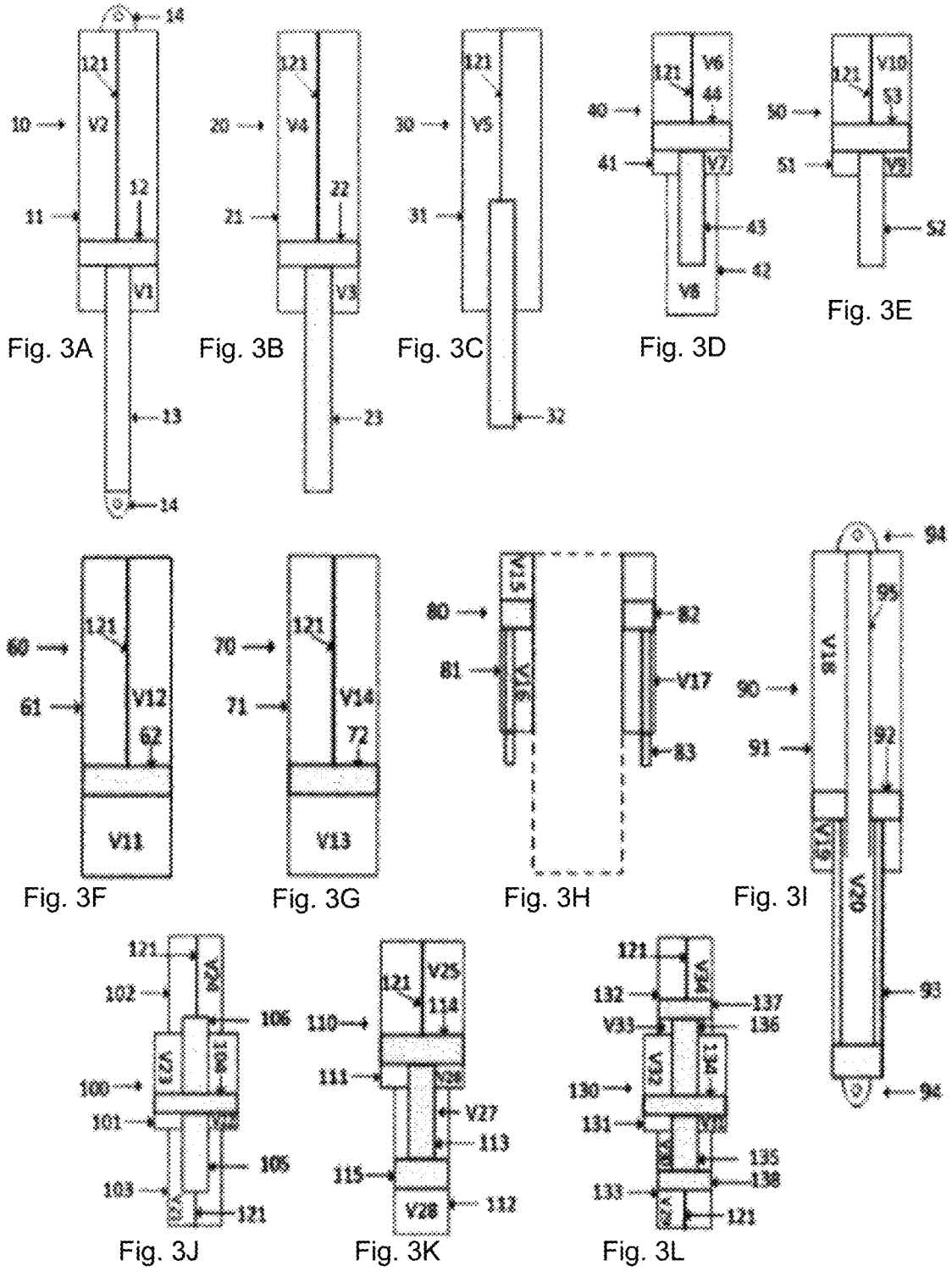
FIG. 3A shows schematically a first hydraulic cylinder type used in the present invention.
FIG. 3B shows schematically a second hydraulic cylinder type used in the present invention.
FIG. 3C shows schematically a third hydraulic cylinder type used in the present invention.
FIG. 3D shows schematically a fourth hydraulic cylinder type used in the present invention.
FIG. 3E shows schematically a fifth hydraulic cylinder type used in the present invention.
FIG. 3F shows schematically a sixth hydraulic cylinder type used in the present invention.
FIG. 3G shows schematically a seventh hydraulic cylinder type used in the present invention.
FIG. 3H shows schematically an eighth hydraulic cylinder type used in the present invention.
FIG. 3I shows schematically a ninth hydraulic cylinder type used in the present invention.
FIG. 3J shows schematically a tenth hydraulic cylinder type used in the present invention.
FIG. 3K shows schematically an eleventh hydraulic cylinder type used in the present invention.
FIG. 3L shows schematically a twelfth hydraulic cylinder type used in the present invention.

The following section will describe how a mobile active heave compensator, MAHC 1000, as shown in FIG. 2, according to the present invention works. The heave compensator is hanging from a hook 1006 and a wire associated with a crane or the like 1009 on the vessel 1008. A payload 1004 is suspended from the mobile heave compensator 1000. The passive heave compensation part (1001), which usually is a hydraulic actuator of some sort connected to one or more gas accumulator, which in turn might be connected to one or more gas tanks, carries the weight of the payload. The passive heave compensation part acts like a spring due to the compressibility of the gas. Friction and force variations due to gas compression when the actuator is reciprocating, is unwanted effects that causes force variations to act on the payload and generates acceleration. The active heave compensation part 1002, which usually is one or more hydraulic pumps connected to some surface in the system, removes these effects by using a counter force of the same magnitude as the unwanted force. Control of the active heave compensation part 1002 is provided by sensor device 120, usually position sensors and Motion Reference units (MRU). If and when the active heave compensation part 1002 is disabled the mobile active heave compensator 1000 works like a passive heave compensator.

FIGS. 3A-3L show the various hydraulic cylinder types that the various embodiments consist of. It is possible to define an almost infinite number of combination that will give a functioning design. FIGS. 3A-3L show the following:

A first actuator 10, consisting of a first cylinder 11 having an upper end and a lower end, a connection device 14 mounted at the upper end of the first cylinder 11, a first piston 12 located within the first cylinder 11 and adapted for reciprocation with respect thereto, a first piston rod 13 connected to the first piston 12 and extending downwardly therefrom through the lower end of the first cylinder 11, a connector device 14 located at the lower end of the first cylinder 11, a first volume V1 located between the first piston 12 and the lower end of the first cylinder 11, a second volume V2 located between the first piston 12 and the upper end of the first cylinder 11. The first actuator 10 is used in many embodiments to carry the weight of the payload 1004 and is connected between the crane hook 1006 and the payload 1004.

A second actuator 20, consisting of a second cylinder 21 having an upper end and a lower end, a second piston 22 located within the second cylinder 21 and adapted for reciprocation with respect thereto, a second piston rod 23 connected to the second piston 22 and extending downwardly therefrom through the lower end of the second cylinder 21, a third volume V3 located between the second piston 22 and the lower end of the second cylinder 21, a fourth volume V4 located between the second piston 22 and the upper end of the second cylinder 21. The second actuator 20 is used in combination with an active element 1002 to cancel unwanted forces coming from gas compression and seal friction.

A third actuator 30, consisting of a third cylinder 31 having an upper end and a lower end, a rod 32 adapted for reciprocation with respect to the third cylinder and extending downwardly therefrom through the lower end of the third cylinder 31, a fifth volume V5 inside the third cylinder 21 displaced by the rod 32. The third actuator 30 is used in combination with an active element 1002 to cancel unwanted forces coming from gas compression and seal friction.

A pressure intensifier 40, consisting of a fourth cylinder 41, a fifth cylinder 42, a third piston rod (43) and a third piston (44), forming a sixth volume (V6) between one end of the fourth cylinder (41) and the third piston (44), a seventh volume (V7) between the other end of the fourth cylinder (41) and the third piston (44), and an eighth volume (V8), between the ends of the fifth cylinder (42). Pressure intensifiers (40) are used to increase pump flow or can also work in combination with active elements (1002) to provide an extra pressure surface.

A depth compensator (50), consisting of a sixth cylinder (51), a fourth piston rod (52) exposed to external pressure and a fourth piston (53), forming a ninth volume (V9) between one end of the sixth cylinder (51) and the fourth piston (53), a tenth volume (V10) between the other end of the sixth cylinder (51) and the fourth piston (53). Depth compensators (50) are used to cancel the effect of hydrostatic pressure acting on piston rods exposed to external pressure.

A first gas accumulator (60), consisting of a seventh cylinder (61) and a fifth piston (62) forming an eleventh volume (V11) between one end of the seventh cylinder (61) and the fifth piston (62), a twelfth volume (V12) between the other end of the seventh cylinder (61) and the fifth piston (62). Gas accumulators (60) are used as spring elements or as an oil source for pumps.

A second gas accumulator (70), consisting of an eighth cylinder (71) and a sixth piston (72) forming a thirteenth volume (V13) between one end of the eighth cylinder (71) and the sixth piston (72), a fourteenth volume (V14) between the other end of the eighth cylinder (71) and the sixth piston (72). Gas accumulators (70) are used as spring elements or as an oil source for pumps.

A ring based depth compensator (80), consisting of a ninth cylinder (81), a first ring piston (82), a first ring piston rod (83) exposed to external pressure, forming a fifteenth volume (V15) between one end of the ninth cylinder (81) and the first ring piston (82), a sixteenth volume (V16) between the other end of the ninth cylinder (81) and the first ring piston (82), the inner diameter of the first ring piston rod (83) and the outer diameter of the inner cylinder (can be any cylinder, shown with dashed lines in figures), a seventeenth volume (V17) between the other end of the ninth cylinder (81) and the first ring piston (82), the outer diameter of the first ring piston rod (83) and the inner diameter of the ninth cylinder (81). Depth compensators (80) are used to cancel the effect of hydrostatic pressure acting on piston rods exposed to external pressure.

A hollow rod actuator (90), consisting of a tenth cylinder (91) having an upper end and a lower end, a connection device (94) mounted at the upper end of the tenth cylinder (91), a second ring piston (92) located within the tenth cylinder (91) and adapted for reciprocation with respect thereto, a second ring piston rod (93) connected to the second ring piston (92) and extending downwardly therefrom through the lower end of the tenth cylinder (91) with a sealed lower end, a connector device (94) located at the end of the second ring piston rod (91), an eleventh cylinder (95) mounted concentric with the tenth cylinder (91) at one end of the tenth cylinder (91) and with the other end inside the inner volume of the second ring piston rod (93), an eighteenth volume (V18) located between the second ring piston (92), the outer diameter of the eleventh cylinder (95) and the lower end of the tenth cylinder (91), a nineteenth volume (V19) located between the second ring piston (92), the outer diameter of the ring piston rod (93) and the lower end of the tenth cylinder (91), a twentieth volume (V20) located between the inner diameter of the eleventh cylinder (95), the inner diameter of the ring piston rod (93), one end of the tenth cylinder (91) and one end of the ring piston rod (93). Hollow rod actuators (90) provide extra pressure surfaces that are suitable to be used with active elements (1002) to cancel unwanted forces coming from gas compression and seal friction.

A double acting pressure intensifier (100), consisting of a twelfth cylinder (101) mounted concentric between a thirteenth cylinder (102) at the upper end of the twelfth cylinder (101) and a fourteenth cylinder (103) at the lower end of the twelfth cylinder (101), a seventh piston (104), a fifth piston rod (105) connected to the lower end of the seventh piston (104) and a sixth piston rod (106) connected to the upper end of the seventh piston (104), forming a twenty-first volume (V21) between one end of the fourteenth cylinder (103) and the lower end of the twelfth cylinder (101) displaced by the fifth piston rod, a twenty-second volume (V22) between the lower end of the twelfth cylinder (101), the lower end of the seventh piston (104) and the outer diameter of the fifth piston rod (105), a twenty-third volume (V23) between the upper end of the twelfth cylinder (101), the upper end of the seventh piston (104) and the outer diameter of the sixth piston rod (106), a twenty-fourth volume (V24) between one end of the thirteenth cylinder (102) and the upper end of the twelfth cylinder (101) displaced by the sixth piston rod (106). Double acting pressure intensifiers (100) can act as spring elements as well as pressure surfaces for active elements (1002) to cancel unwanted forces coming from gas compression and seal friction.

A second pressure intensifier (110), consisting of a fifteenth cylinder (111), a sixteenth cylinder (112), a seventh piston rod (113), an eighth piston (114) and a ninth piston (115), forming a twenty-fifth volume (V25) between one end of the fifteenth cylinder (111) and the eighth piston (114), a twenty-sixth volume (V26) between the other end of the fifteenth cylinder (111) and the eighth piston (114), a twenty-seventh volume (V27) between the upper end of the sixteenth cylinder (112) and the ninth piston (115) and a twenty-eighth volume (V28), between the lower end of the sixteenth cylinder (112) and the ninth piston (115). The second pressure intensifier (110) is an alternative to the first pressure intensifier (40) with almost the same functionality, the main difference is additional surfaces.

A second double acting pressure intensifier (130), consisting of a seventeenth cylinder (131) mounted concentric between a eighteenth cylinder (132) at the upper end of the seventeenth cylinder (131) and a nineteenth cylinder (133) at the lower end of the seventeenth cylinder (131), a tenth piston (134), an eight piston rod (135) connected to the lower end of the seventh piston (134) and a ninth piston rod (136) connected to the upper end of the tenth piston (134), an eleventh piston (137) connected to the upper end of the ninth piston rod (136), a twelfth piston (138) connected to the lower end of the eighth piston rod (135), forming a twenty-ninth volume (V29) between one end of the nineteenth cylinder (133) and the lower end of the twelfth piston (138), a thirtieth volume (V30) between the upper end of the nineteenth cylinder (133) and the upper end of the twelfth piston (138) displaced by the eight piston rod (135), a thirty-first volume (V31) between the lower end of the seventeenth cylinder (131) and the lower end of the tenth piston (134) displaced by the eight piston rod (135), a thirty-second volume (V32) between the upper end of the seventeenth cylinder (131) and the upper end of the tenth piston (134) displaced by the ninth piston rod (136), a thirty-third volume (V33) between the lower end of the eighteenth cylinder (132) and the lower end of the eleventh piston (137) displaced by the ninth piston rod (136), a thirty-fourth volume (V34) between the upper end of the eighteenth cylinder (132) and the upper end of the eleventh piston (137). The second double acting pressure intensifier (130) is an alternative to the first double acting pressure intensifier (100) with almost the same functionality, the main difference is additional surfaces.

The figures below show many different embodiments of the mobile active heave compensator (1000) with focus only on the basic hydraulic layout. Most sensors and all valves are not shown. The details of each component are not repeated as it can be found under the descriptions of FIGS. 3A-3L.

Figure 4:
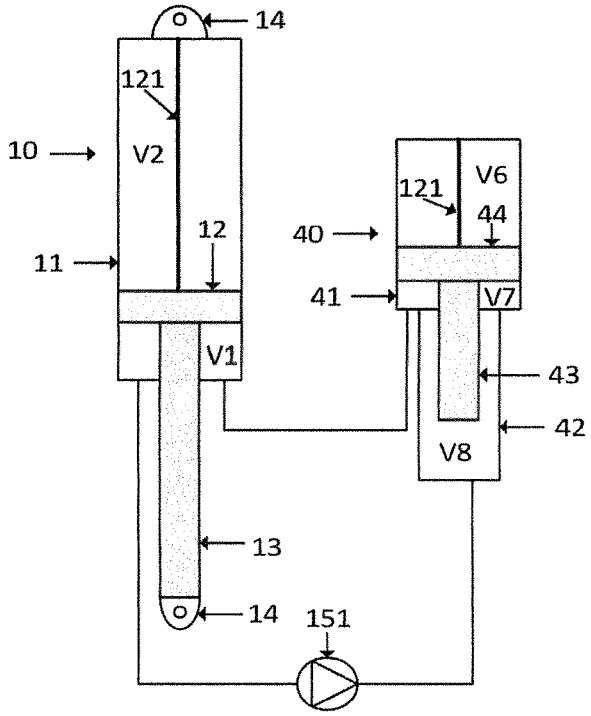
FIG. 4 shows schematically a first embodiment of a Mobile Active Heave Compensator (MAHC) assembly, comprising an actuator and pressure intensifier and a hydraulic fluid transportation device.

FIG. 4 shows a first embodiment of the mobile active heave compensator (1000) comprising a first actuator (10), where the first volume (V1) is filled with oil and the second volume (V2) is under vacuum, a pressure intensifier (40), where the sixth volume (V6) is filled with gas, the seventh volume (V7) is filled with oil and the eighth volume (V8) is filled with oil, conduit device connecting the seventh volume (V7) to the first volume (V1), conduit device connecting the first volume (V1) to the eighth volume (V8) via a device for hydraulic fluid transportation (151). As indicated in the Figure, both the actuator 10 and the pressure intensifier 40 may be provided with a position 121, measuring the position of the pistons 12 and 44 respectively.

Figure 5:
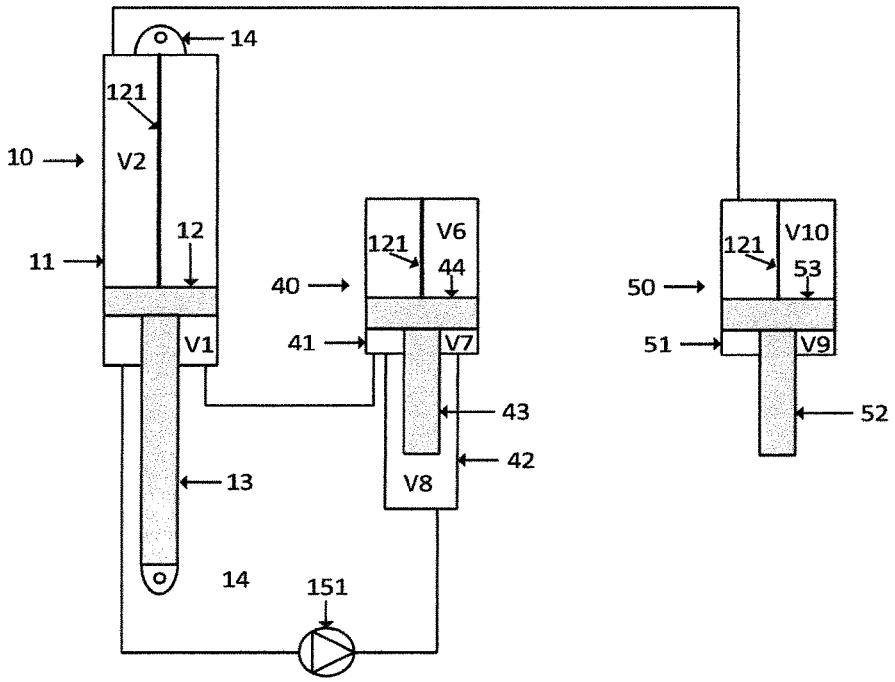
FIG. 5 shows schematically another embodiment of a Mobile Active Heave Compensator (MAHC) assembly, comprising an actuator, a pressure intensifier, a fluid transportation device and a depth compensator.

FIG. 5 shows another embodiment of the mobile active heave compensator (1000), the compensator 1000 comprises a first actuator (10), where the first volume (V1) is filled with oil and the second volume (V2) is filled with oil, a depth compensator (50), where the tenth volume (V10) is filled with oil, and the ninth volume (V9) is either filled with gas or under vacuum, a pressure intensifier (40), where the sixth volume (V6) is filled with gas, the seventh volume (V7) is filled with oil and the eighth volume (V8) is filled with oil, conduit device connecting the seventh volume (V7) to the first volume (V1), conduit device between the second volume (V2) and the tenth volume (V10), conduit device connecting the first volume (V1) to the eighth volume (V8) via a device for hydraulic fluid transportation (151). Bothe the actuator 10, the pressure intensifier 40, and the depth compensator 50 may be provided with a position sensor, registering the position of the pistons 12, 44, and 53 respectively.

Figure 6:
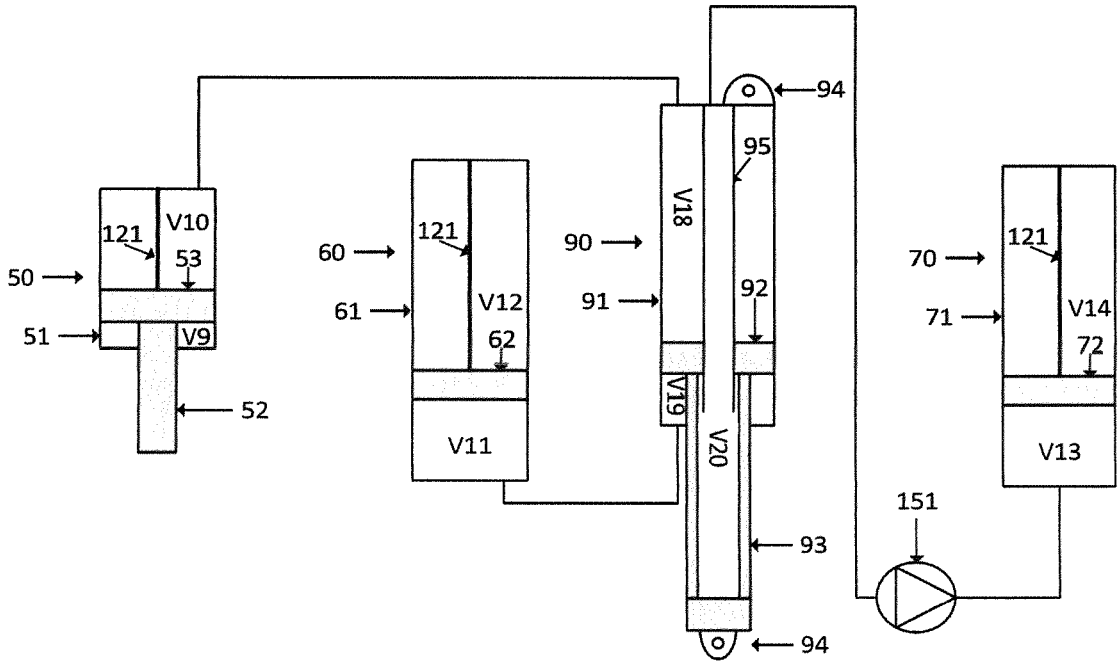
FIG. 6 shows schematically another embodiment of Mobile Active Heave Compensator (MAHC) assembly, comprising a hollow rod actuator, a depth compensator; two separate gas accumulators and a hydraulic fluid transportation device.

FIG. 6 shows an embodiment of the mobile active heave compensator (1000) comprising a hollow rod actuator (90), where the eighteenth volume (V18) is filled with oil, the nineteenth volume (V19) is filled with oil and the twentieth volume (V20) is filled with oil, a depth compensator (50), where the tenth volume (V10) is filled with oil, and the ninth volume (V9) is either filled with gas or under vacuum, a first gas accumulator (60), where the eleventh volume (V11) is filled with oil and the twelfth volume (V12) is filled with gas, a second gas accumulator (70), where the thirteenth volume (V13) is filled with oil and the fourteenth volume (V14) is filled with gas, conduit device connecting the eleventh volume (V11) to the nineteenth volume (V19), conduit device between the eighteenth volume (V18) and the tenth volume (V10), conduit device connecting the twentieth volume (V20) to the thirteenth volume (V13) via a device for hydraulic fluid transportation (151). The depth compensator 50 and the first and the second gas accumulator 60,70 are provided with a position sensor 121 for registering the position of the pistons 53, 62 and 72 respectively.

Figure 7:
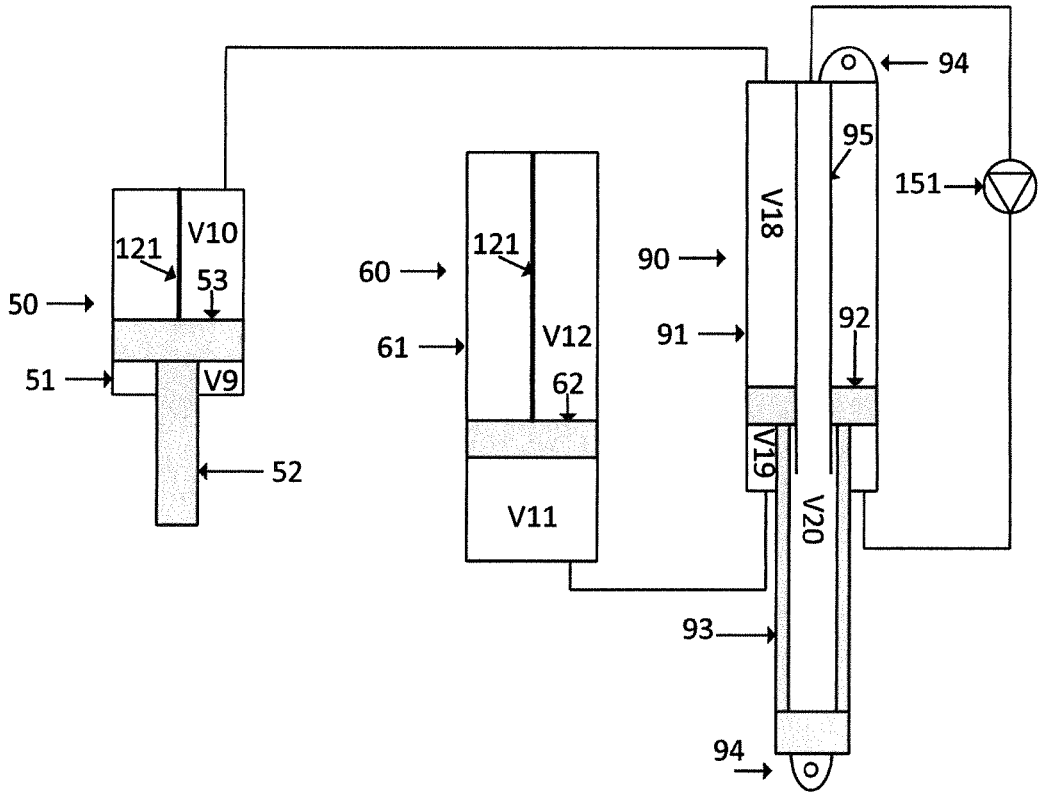
FIG. 7 shows schematically an embodiment of a Mobile Active Heave Compensator (MAHC) assembly, comprising a hollow rod actuator a depth compensator, a gas accumulator and a hydraulic fluid transportation device.

FIG. 7 shows yet another embodiment of the mobile active heave compensator (1000) comprising a hollow rod actuator (90), where the eighteenth volume (V18) is filled with oil, the nineteenth volume (V19) is filled with oil and the twentieth volume (V20) is filled with oil, a depth compensator (50), where the tenth volume (V10) is filled with oil, and the ninth volume (V9) is either filled with gas or under vacuum, a first gas accumulator (60), where the eleventh volume (V11) is filled with oil and the twelfth volume (V12) is filled with gas, conduit device connecting the eleventh volume (V11) to the nineteenth volume (V19), conduit device between the eighteenth volume (V18) and the tenth volume (V10), conduit device connecting the twentieth volume (V20) to the nineteenth volume (V19) via a device for hydraulic fluid transportation (151). The depth compensator 50 and the gas accumulator 60 are provided with a position sensor 121 for registering the position of the pistons 53 and 62 respectively.

Figure 8:
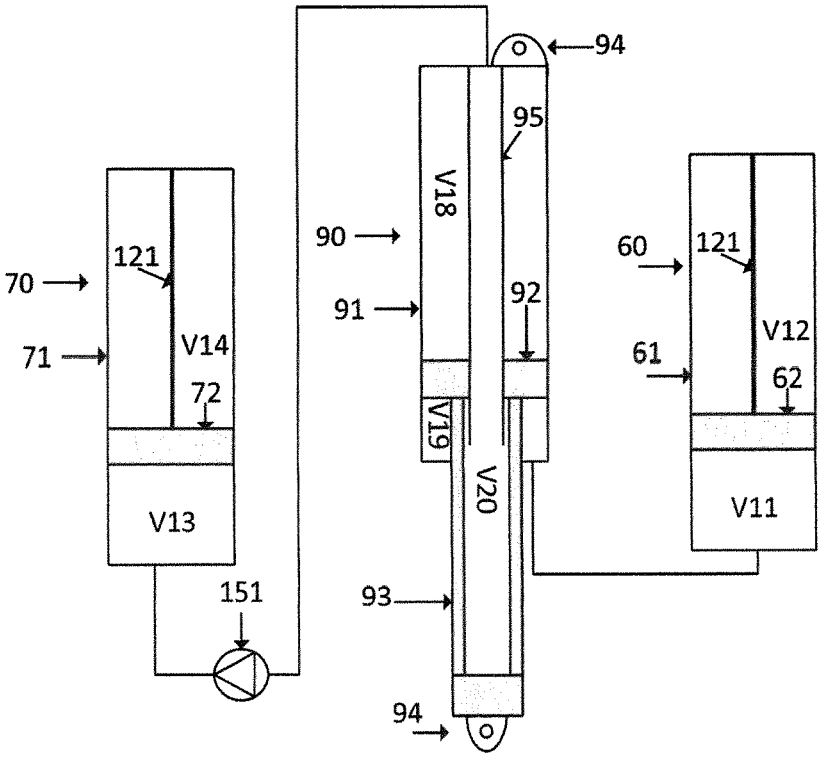
FIG. 8 shows schematically an embodiment of a Mobile Active Heave Compensator (MAHC) assembly, comprising a hollow rod actuator, two gas accumulator and a hydraulic fluid transportation devices.

FIG. 8 shows an embodiment of the mobile active heave compensator (1000) comprising a hollow rod actuator (90), where the eighteenth volume (V18) is under vacuum or filled with gas, the nineteenth volume (V19) is filled with oil and the twentieth volume (V20) is filled with oil, a first gas accumulator (60), where the eleventh volume (V11) is filled with oil and the twelfth volume (V12) is filled with gas, a second gas accumulator (70), where the thirteenth volume (V13) is filled with oil and the fourteenth volume (V14) is filled with gas, conduit device connecting the eleventh volume (V11) to the nineteenth volume (V19), conduit device connecting the twentieth volume (V20) to the thirteenth volume (V13) via a device for hydraulic fluid transportation (151). Both of the to gas accumulators 60,70 are provided with a position sensor 121, registering the position of the pistons 62,72, respectively.

Figure 9:
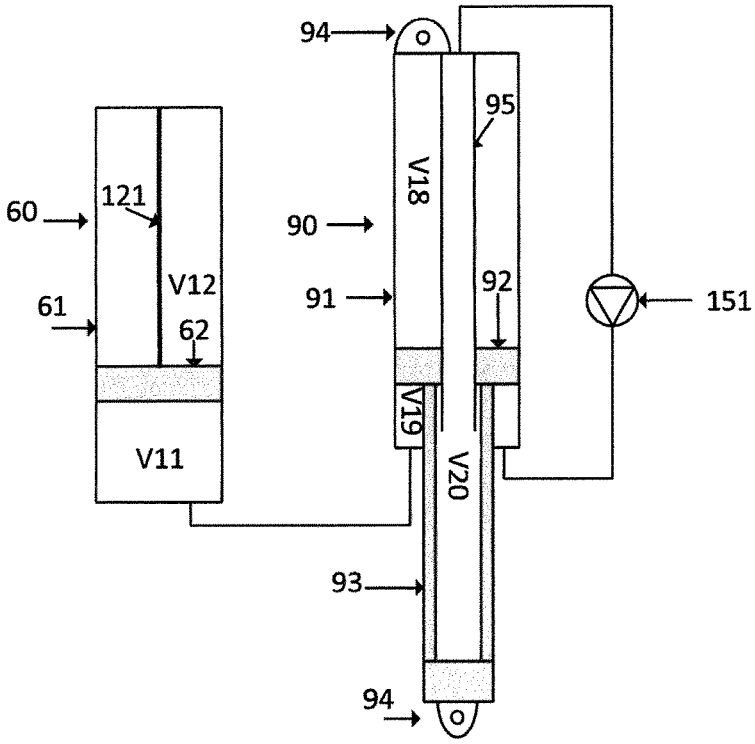
FIG. 9 shows schematically an embodiment of a Mobile Active Heave Compensator (MAHC) assembly, comprising a hollow rod actuator, a gas accumulator and a hydraulic fluid transportation device.

FIG. 9 shows an embodiment of the mobile active heave compensator (1000) comprising a hollow rod actuator (90), where the eighteenth volume (V18) is under vacuum or filled with gas, the nineteenth volume (V19) is filled with oil and the twentieth volume (V20) is filled with oil, a first gas accumulator (60), where the eleventh volume (V11) is filled with oil and the twelfth volume (V12) is filled with gas, conduit device connecting the eleventh volume (V11) to the nineteenth volume (V19), conduit device connecting the twentieth volume (V20) to the nineteenth volume (V19) via a device for hydraulic fluid transportation (151). The gas accumulator 60 may be provided the position sensor, registering the position of the piston 62.

Figure 10:
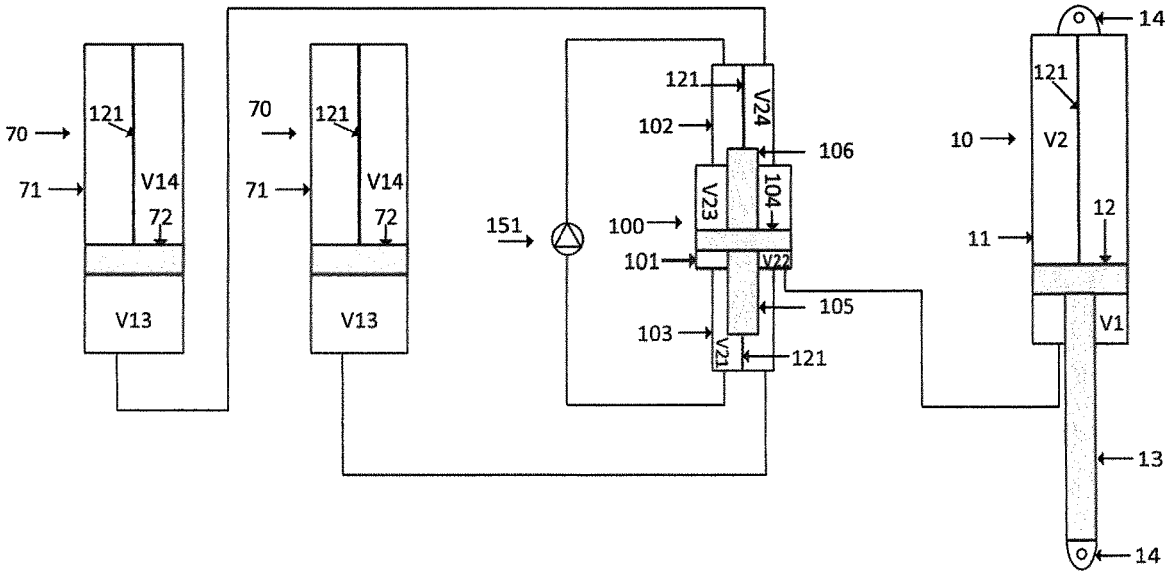
FIG. 10 shows schematically an embodiment of a Mobile Active Heave Compensator (MAHC) assembly, comprising an actuator, a double acting pressure intensifier, two gas accumulators and a hydraulic fluid transportation device.

FIG. 10 shows an embodiment of the mobile active heave compensator (1000) comprising a first actuator (10), where the first volume (V1) is filled with oil and the second volume (V2) is filled with gas or is under vacuum, at least one second gas accumulator(s) (70), where the thirteenth volume (V13) is filled with oil and the fourteenth volume (V14) is filled with gas, a double acting pressure intensifier (100), where the twenty-fourth volume (V24) is filled with oil, the twenty-third volume (V23) is filled with gas, the twenty-second volume (V22) is filled with oil and the twenty-first volume (V21) is filled with oil, conduit device connecting the twenty-second volume (V22) to the first volume (V1), conduit device connecting the twenty-fourth volume (V24) to at least one of the oil filled volumes (V13) of the second gas accumulator(s) (70), conduit device connecting the twenty-first volume (V21) to at least one of the oil filled volumes (V13) of the second gas accumulator(s) (70), conduit device connecting the twenty-first volume (V21) and the twenty-fourth volume (V24) via a device for hydraulic fluid transportation (151).

Figure 11:
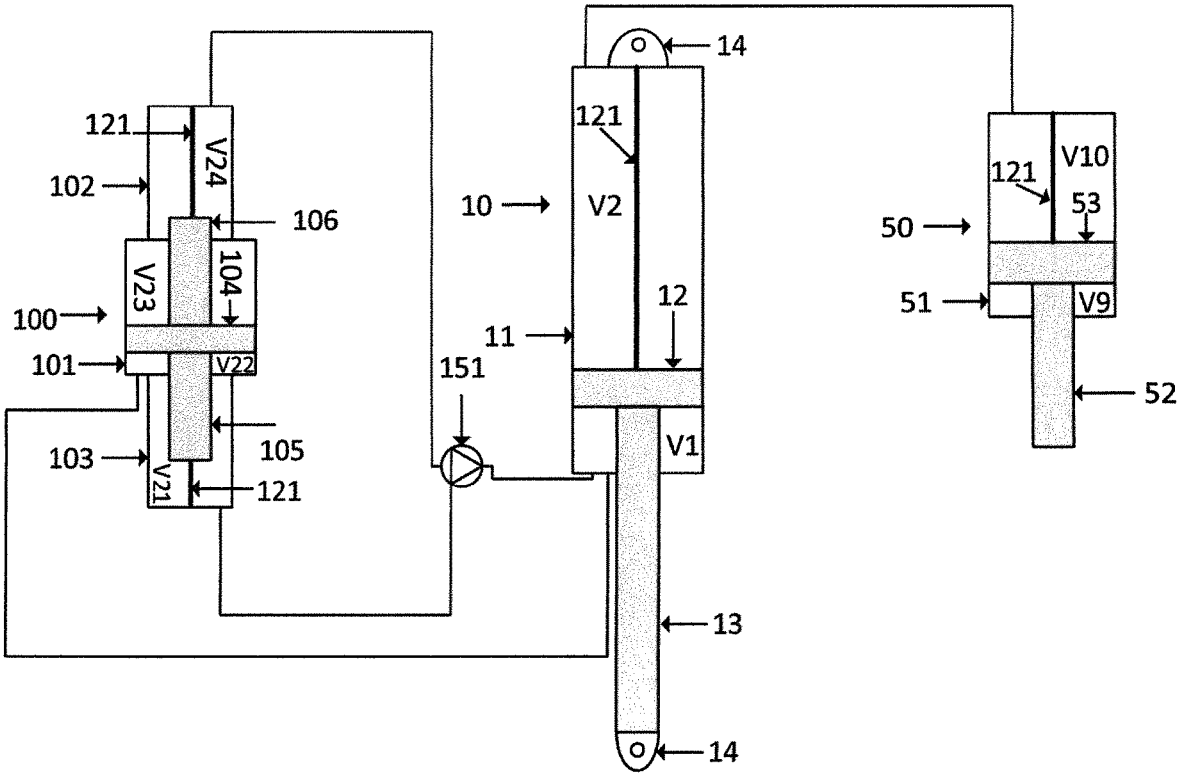
FIG. 11 shows schematically an embodiment of a Mobile Active Heave Compensator (MAHC) assembly, comprising n actuator, a depth compensator, a double acting pressure intensifier, and a hydraulic fluid transportation device.

FIG. 11 shows an embodiment of the mobile active heave compensator (1000) comprising a first actuator (10), where the first volume (V1) is filled with oil and the second volume (V2) is filled oil, a depth compensator (50), where the tenth volume (V10) is filled with oil, and the ninth volume (V9) is either filled with gas or under vacuum, a double acting pressure intensifier (100), where the twenty-fourth volume (V24) is filled with oil, gas or is under vacuum, the twenty-third volume (V23) is filled with gas, the twenty-second volume (V22) is filled with oil and the twenty-first volume (V21) is filled with oil, conduit device connecting the twenty-second volume (V22) to the first volume (V1), conduit device connecting the second volume (V2) to the tenth volume (V10), conduit device connecting at least two of the following volumes via a device for hydraulic fluid transportation (151): the twenty-fourth volume (V24), the first volume (V1), the twenty-first volume (V21).

Figure 12:
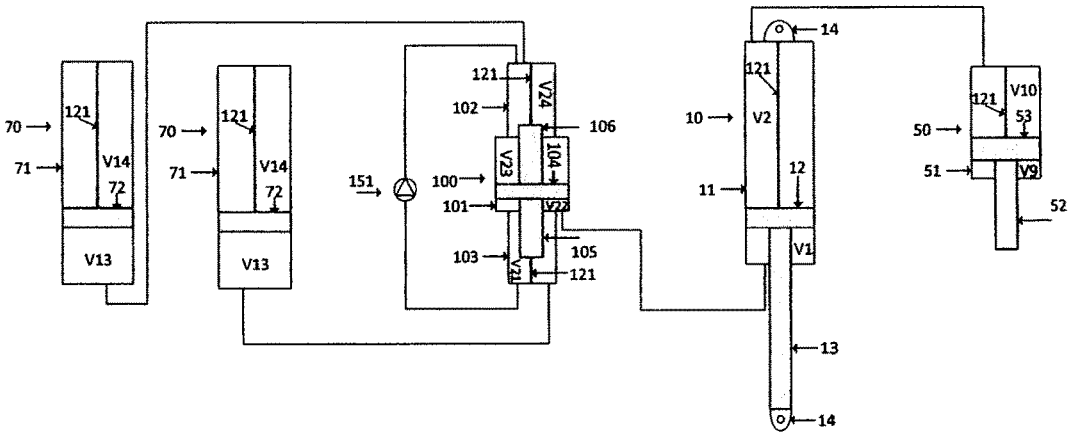
FIG. 12 shows schematically an embodiment of a Mobile Active Heave Compensator (MAHC) assembly, comprising an actuator, a depth compensator, a double acting pressure intensifier, two separated gas accumulators and a hydraulic fluid transportation device.

FIG. 12 shows an embodiment of the MAHC (1000) comprising a first actuator (10), where the first volume (V1) is filled with oil and the second volume (V2) is filled oil, a depth compensator (50), where the tenth volume (V10) is filled with oil, and the ninth volume (V9) is either filled with gas or under vacuum, at least one second gas accumulator(s) (70), where the thirteenth volume (V13) is filled with oil and the fourteenth volume (V14) is filled with gas, a double acting pressure intensifier (100), where the twenty-fourth volume (V24) is filled with oil, the twenty-third volume (V23) is filled with gas, the twenty-second volume (V22) is filled with oil and the twenty-first volume (V21) is filled with oil, conduit device connecting the second volume (V2) to the tenth volume (V10), conduit device connecting the twenty-second volume (V22) to the first volume (V1), conduit device connecting the twenty-fourth volume (V24) to at least one of the oil filled volumes (V13) of the second gas accumulator(s) (70), conduit device connecting the twenty-first volume (V21) to at least one of the oil filled volumes (V13) of the second gas accumulator(s) (70), conduit device connecting the twenty-first volume (V21) and the twenty-fourth volume (V24) via a device for hydraulic fluid transportation (151).

Figure 28:
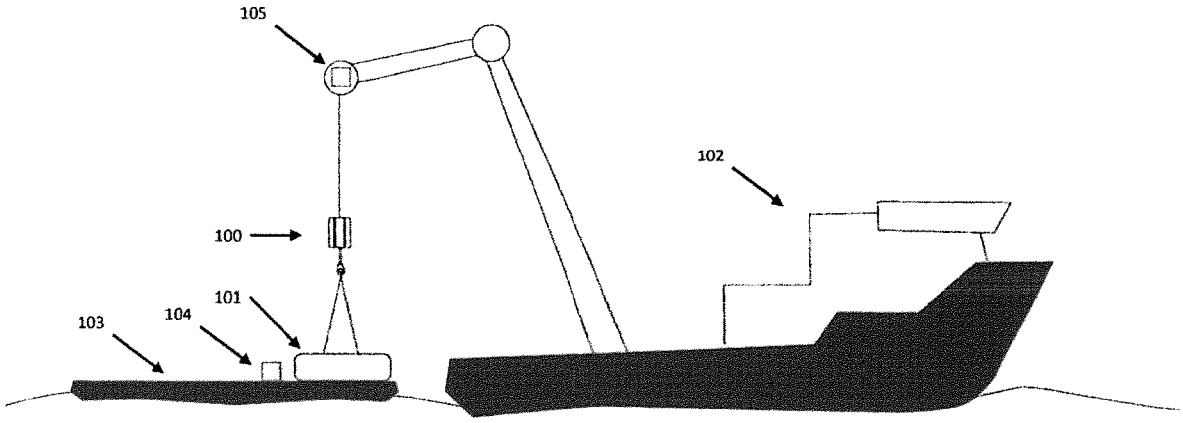
FIG. 28 shows schematically a process of placing a payload on a floating barge using a mobile active heave compensator in a topside lift positioned in air immediately above the barge.

The following section will describe how another exemplified group of mobile active heave compensator, (100) according to the present invention works during different phases of an offshore subsea lift. It is assumed that a payload (101) is initially on a barge (103) next to an installation vessel (102), as shown in FIG. 28. This payload (101) has to be retrieved by the vessel (102). Then the payload (101) needs to cross the splash zone. Next there is a long descent of the payload (101) into deeper waters and finally landing of the equipment (101) on a seabed (106), as shown in FIG. 2. Here the payload 04) should be at rest relative to the seabed 107. An accelerometer (120) can measure the position of the compensator (1000), which position is affected by the movement of the vessel (1008)). Piston or piston rod sensors can measure the movement of the payload (1004). If the payload (10041) is not at rest, the oil or hydraulic fluid pump will either push or brake the first or main piston 12, so that the net movement of the payload (1004) will be zero.

The mobile active heave compensator (100) can comprise a sensing arrangement or devices, such as for example at least one piston position sensor (121). Based on direct or indirect measurements from at least one of these sensors (6, 10, 19), the compensator will be able to calculate how a device for hydraulic fluid transportation (1517) should operate to transport hydraulic fluid between a hydraulic fluid volume in a first cylinder (10) and another hydraulic fluid volume in another (fourth) cylinder (50) in order to continuously have a net zero relative motion between a second connection device (14) located at a lower end of a first piston rod (3) within the first cylinder (1) and the seabed (1007). When the payload (1004) is connected, the pressure in the first cylinder (10) is increased to almost carry the load (about 90% of static weight) of the payload (1004). When desired by the crane operator, a fast pressure increase can be performed to quickly lift (i.e. faster than normal crane speed) the payload (1004) from the barge (103) in order to reduce risk of contact between the barge (103) deck and the payload (1004) after lift-off, the pressure increase is performed by injecting gas from a fourth cylinder (14) or by connecting a fifth cylinder (24) to a second cylinder (60). The barge (103) is then moved away, and the payload (1004) is ready to cross the splash zone. During the splash zone crossing phase, the compensator (1000) is operating in a passive mode, with no active control of the first piston rod (13) except for equilibrium adjustments (wanted equilibrium position is pre-set) due to environmental disturbances, such as increased buoyancy and/or changing temperature. After crossing the splash zone, the stiffness of the compensator (1000) is reduced by connecting a fifth cylinder (24). This is crucial to provide good resonance protection. During the lowering phase, the device for hydraulic fluid transportation (17) can be used to charge an energy source (16), adapted for power supplying the compensator (1000), by utilizing the hydraulic fluid flow in the compensator (1000). The equilibrium position of the first piston rod (13) is maintained by a device for gas transportation (151) that adjusts the pressure of the different compensator volumes in the cylinders. The landing phase mode is either activated based upon water depth or activated by an ROV (the ROV turns a switch on the IAHC (1000)). During this phase, the heave motion of the payload (1004) will be close to zero, and it can safely be installed. The heave motion is partly compensated by the passive spring (i.e. a gas volume in the second cylinder (60), or a gas volume in the second cylinder (60) plus a gas volume in the fifth cylinder (24)).

The sketches or figures shown are intended to show the principles of the invention, wherein numerous variations with a number of accumulators and tanks can be utilized in order to get the same results.

Figure 13:
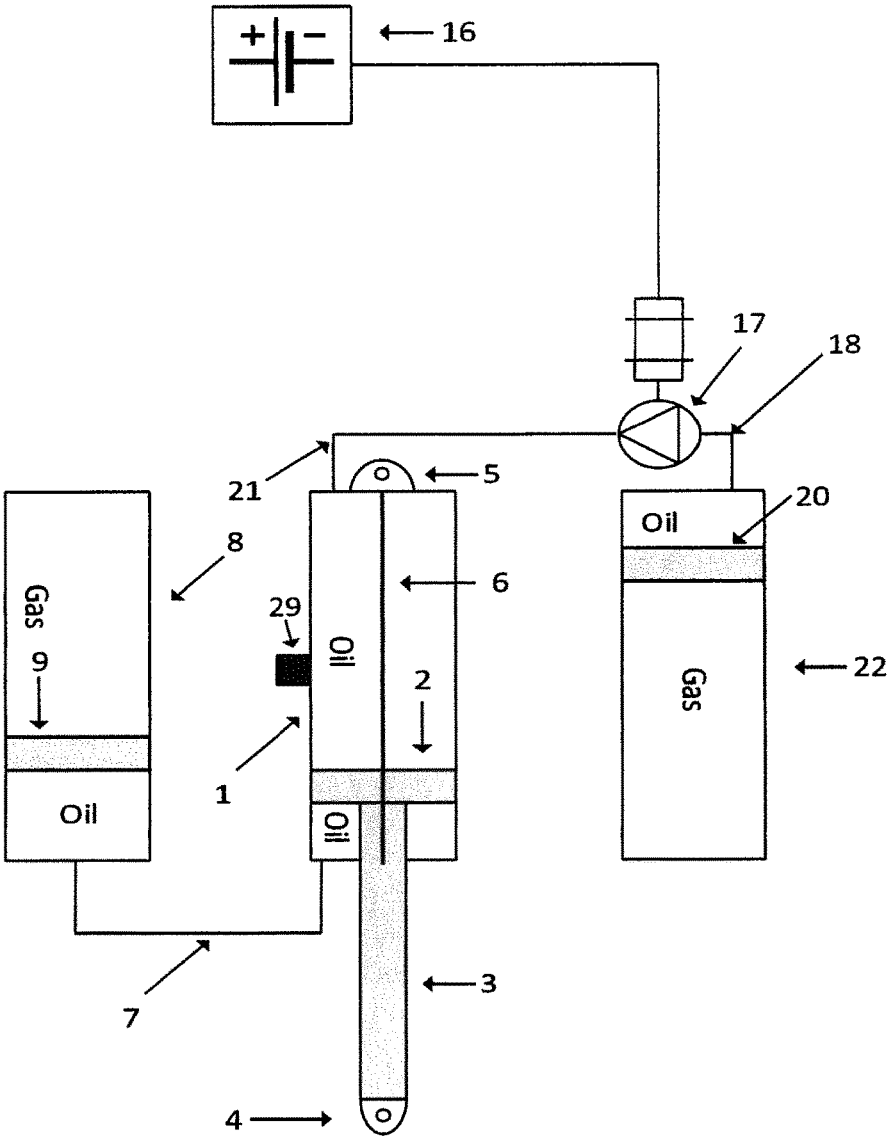
FIG. 13 shows schematically a basic version or embodiment of a mobile active heave compensator, according to one variant of the invention.

FIG. 13 illustrates a basic version or embodiment of a mobile active heave compensator 1000 with all major sub-components numbered, mainly intended for simple subsea lifts. The component description is identified in Table 1. The mobile active heave compensator 1000, comprises a first cylinder (1) with a first connection device (5) at its upper end (5) connected to a vessel (1008) or a payload (1004). A second connection device (14), arranged at the lower end of the first cylinder (10), is connected to the vessel (1008) or the payload (1004).

Figure 14:
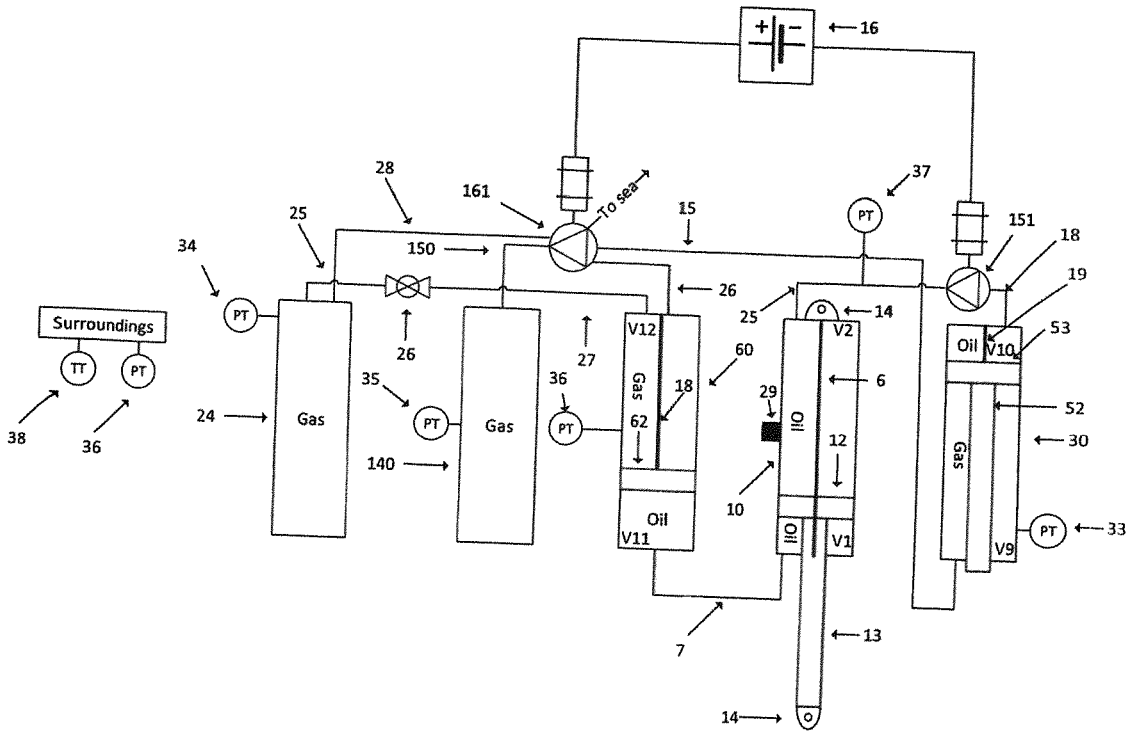
FIG. 14 shows schematically an embodiment of a mobile active heave compensator, comprising an actuator, a depth compensator, a gas accumulator two gas tanks and a hydraulic fluid transportation device and a gas transportation device.

FIG. 14 illustrates a more sophisticated version or embodiment of a mobile active heave compensator 1000 with all major sub-components numbered, mainly intended for more advanced topside and subsea lifts.

The version or embodiment of the compensator 1000, shown in FIG. 14, is fitted with a second piston rod (52) in a third cylinder (50) used for passive depth compensation, which is considered to be beneficial for small compensators.

The compensator 1000 is normally rigged to a work wire coming from the vessel (1008) at either the second connection device (4), where the second connection device (14) is facing down, or the first connection device (14), where the first connection device 15 is facing up. The connection device 14 not connected to the vessel (1008 is connected to the payload (1004). If necessary or desired, any one of the connection devices 14 can be connected to both the vessel (1008) and the payload (1004). The connection device 14) can be at least one of: a padeye and a clevis, but not limited only thereto.

The first cylinder (the actuator) 10 comprises a first piston (12). A first piston rod (13) extends from the first piston (12) located within the first cylinder (10) through the lower end thereof. The first cylinder (10) contains a first volume V1 of hydraulic fluid located between the first piston (12) and the lower end of the first cylinder (10). The first cylinder (10) also contains a second volume V2 of hydraulic fluid located between the first piston (12) and the upper end of the first cylinder (10). A first piston position sensor (6) may be present in the first cylinder (10). The first piston position sensor (6) can be used to directly calculate the position of at least one of: the first piston (12) and the first piston rod (13), relative to at least one of the upper and lower ends of the first cylinder (10).

The second cylinder (8) contains a second piston (62) separating a third volume of hydraulic fluid located between the lower end of the second cylinder (60) and the second piston (62), as well as a first volume of gas V12 located between the upper end of the second cylinder (60) and the second piston (62). The gas pressure in the first gas volume in the second cylinder (60) effectively pressurizes the first hydraulic fluid volume V12 in the first cylinder (10) via a first conduit device (7) connecting the lower sides of the first (10) and the second (60) cylinder, as well as the third hydraulic fluid volume V11 in the second cylinder (60). A second piston position sensor (18) may be present in the second cylinder (60), as it can be used to indirectly calculate the position of at least one of: the first piston (12) and the first piston rod (13), relative to at least one of the upper and lower ends of the first cylinder (10).

The third cylinder (50) contains a third piston (53). The third cylinder (50) contains a third gas volume V9 located between the third piston (53) and the lower end of the third cylinder (50), as well as a fourth volume V10 of hydraulic fluid located between the third piston (53) and the upper end of the third cylinder (50). The gas pressure in the third gas volume in the third cylinder (50) effectively pressurizes the fourth hydraulic fluid volume V10 in the third cylinder (50). The pressure in the second hydraulic fluid volume V2 in the first cylinder (10) is not necessarily equal to the pressure of the fourth hydraulic fluid volume V10 in the third cylinder (50), because the device for hydraulic fluid transportation (151) can transport hydraulic fluid between the two volumes and create a positive or a negative pressure deviation between them.

The other pistons (62, 33) can move at different speed(s) with respect to the first or main piston (12). The movement between the first piston (12) and/or first piston rod (13) is linked to another piston (62 or 33) by simple or appropriate mathematical relation(s) and/or equation(s).

Other than linear sensors and position sensors that are suitable for the purpose can also be used in the sensing arrangement, such as, but not limited to wire sensor(s), pressure sensor(s), temperature sensor(s), laser(s) or based on ultrasound. There can also be used suitable sensors that can measure or sense the position of the piston rod. For example, at least one pressure sensor (33, 34, 35, 36) adapted for measuring the pressure in each of the gas volumes and at least one pressure sensor (36) adapted for measuring the external pressure (i.e. the pressure of the surroundings (e.g. the sea)), and at least one sensor (37) measuring the pressure on the upper side of the first piston (12) together with at least one temperature sensor (38) adapted for measuring the surroundings temperature can be used as the sensing arrangement in order to indirectly measure the equilibrium position of the main or first piston (12) and/or the piston rod (13) in the first cylinder (10) relative to at least one of the ends of the first cylinder (10). The equilibrium position of the first piston (12) can then be calculated based on appropriate mathematical relation(s) and/or equation(s).

It is also possible to control the hydraulic fluid (17) or the gas transportation device (151) when having in mind that the net force on the payload should be constant. This can be achieved by regulating the pressure on the upper side of the first piston (12). When the pressure on the lower side of the first piston (12) increases due to gas compression, the pressure on the upper side of the first piston (12) will increase simultaneously, so that the net force will be zero.

The fourth cylinder (140) contains a second gas volume. The fourth cylinder (140) can be used as a storage tank for gas.

The fifth cylinder (24) may be present and may contain a fourth gas volume. The fifth cylinder (24) is normally used to extend the volume of gas that the second piston (62) is working against; this is done in order to lower the compression rate.

The device for hydraulic fluid transportation (151) is used to transport hydraulic fluid between the second hydraulic fluid volume V2 in the first cylinder (10) and the fourth hydraulic fluid volume V10 in the third cylinder (50). Hydraulic fluid is transported between the second hydraulic fluid volume V2 in the first cylinder (10) and the device for hydraulic fluid transportation (151) via a sixth conduit device (25) connected to the upper side of the first cylinder (10). Hydraulic fluid is transported between the fourth hydraulic fluid volume V10 in the third cylinder (50) and the device for hydraulic fluid transportation (151) via a fifth conduit device (18) connected to the upper side of the third cylinder (50).

The device for gas transportation (161) is used to transport gas between any combination of the first gas volume, the second gas volume, the third gas volume and the fourth gas volume. The device for gas transportation (161) can also be used to expel gas to the surroundings (i.e. the sea or air) from any one of: the first gas volume, the second gas volume, the third gas volume and the fourth gas volume. Gas is transported between the first gas volume in the second cylinder (60) and the device for gas transportation (161) via a second conduit device (26) connected to the upper side of the second cylinder (60). Gas is transported between the second gas volume in the fourth cylinder (140) and the device for gas transportation (161) via a third conduit device (150). Gas is transported between the third gas volume in the third cylinder (50) and the device for gas transportation (161) via a fourth conduit device (15) connected to the lower side of the third cylinder (50). Gas is transported between the fourth gas volume in the fifth cylinder (24) and the device for gas transportation (161) via a ninth conduit device (28).

Typically, the device for gas transportation (161) can be at least one pressure intensifier or at least one gas compressor driven by either hydraulics, such as e.g. a hydraulic pump (e.g. an electrically powered hydraulic pump setup), or directly by an electric motor.

The device for hydraulic fluid transportation (151) can be at least one reversible hydraulic pump driven by an electric motor.

Any one of the device for hydraulic fluid transportation (151) and the device for gas transportation (161) is powered by an energy source (16), which can be either at least one battery pack (16) integrated into the compensator (100) or an energy source (16) located aboard the vessel (1008) and connected to the compensator (100) via an umbilical.

The hydraulic fluid can normally be a mineral oil or a glycol-water fluid, but not limited only thereto.

An accelerometer (29) can be integrated into the compensator (100) to measure heave motions of the compensator (100). This measurement along with measurements from at least one piston position sensor can be used to control the device for hydraulic fluid transportation (151) when it is subsea. The same signals can also be used topside (i.e. above water).

A valve (26) can be used to separate the first gas volume in the second cylinder 60 and the fourth gas volume in the fifth cylinder (24). The first gas volume in the second cylinder (60) is connected to the valve (26) via an eighth conduit device (27) connected to the upper side of the second cylinder (60). The fourth gas volume in the fifth cylinder (24) is connected to the valve (26) via a seventh conduit device (25). When the valve (26) is open, the volume of the first gas volume is increased to the size of the first gas volume plus the fourth gas volume.

A first MRU (1009), (ref. FIG. 2) short for motion reference unit, can be placed in a crane tip. The first MRU (1009) can transfer its measurements to the compensator (100) either via umbilical or via wireless signals (e.g. when topside). A second MRU can be placed close to the payload (1004), or other payloads, to be lifted off a floating object topside, such as e.g. a barge (103). The second MRU can transfer its measurements to the compensator (100) via e.g. wireless signals. The two MRU units allow the compensator (100) to accurately compensate for heave motions of two vessels (i.e. the barge and the vessel when the compensator (100) is topside). Crane hoisting speed is not disturbed as it can be effectively calculated based on the available measurements. As mentioned the MRUs can transfer the measurements to the compensator (100) wirelessly or via an umbilical.

At least one of the cylinders can be constituted or presented as a group of a predetermined number of cylinders. The predetermined number of cylinders can be arranged in a parallel connection in order to increase the effective volume of at least one volume of the gas and/or hydraulic fluid volumes.

Figure 15:
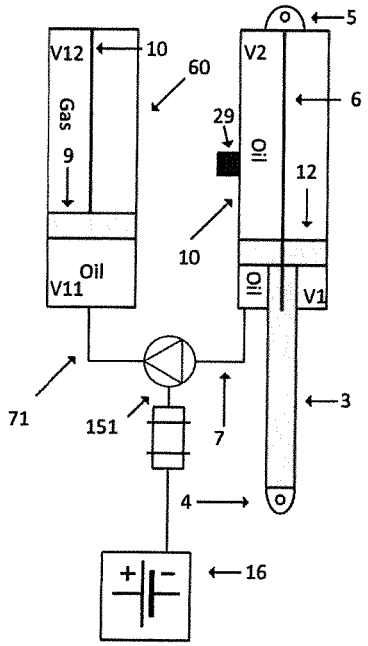
FIG. 15 shows schematically a first embodiment of a mobile semi-active heave compensator, comprising an actuator, an accumulator and a hydraulic fluid transportation device.
Figure 16:
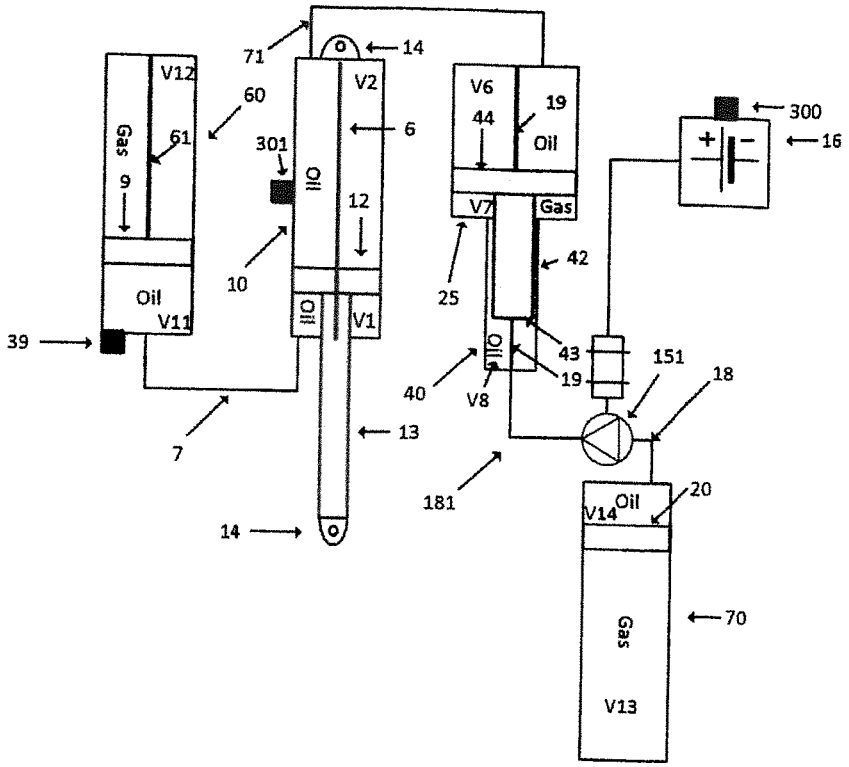
FIG. 16 shows another embodiment of a mobile semi-active heave compensator, comprising an actuator, a pressure intensifier, an accumulator; two separate accumulators and a hydraulic fluid transportation device.
Figure 17:
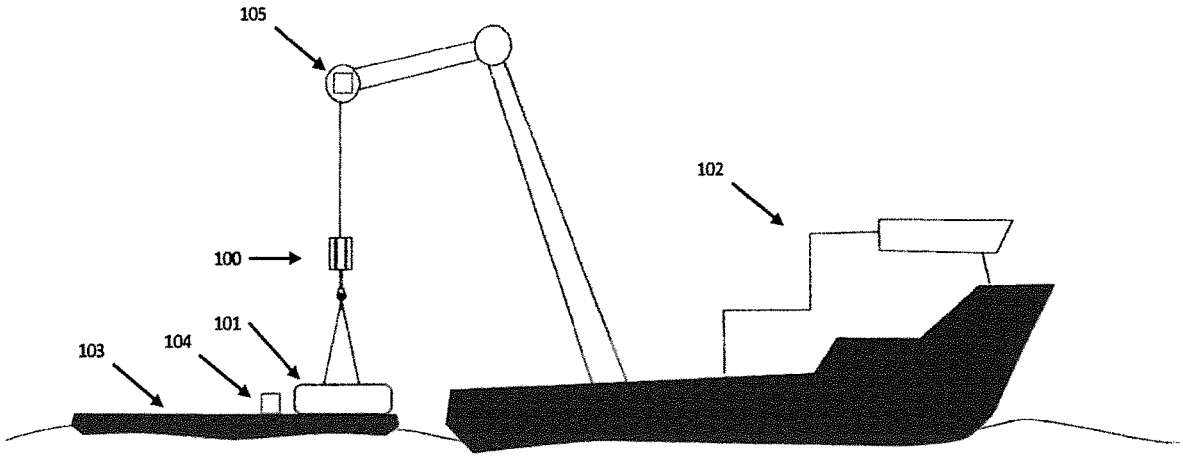
FIG. 17 shows schematically a stage in the process of lifting a payload on the a floating barge, here both the crane vessel and the barge are subjected to waves.

FIGS. 15 and 16 are schematic illustrations of two versions or embodiments of further embodiments of a mobile active heave compensator according to the present invention in which the major component parts of the compensator are specifically identified.

FIG. 15 illustrates a version or embodiment of an semi active heave compensator 100 where the device for hydraulic fluid transportation (151) is connected between the oil side of the first cylinder (10) and the oil side of the second cylinder (60). This removes the need for a separate accumulator for the active part of the compensator. The downside to this is that the device for hydraulic fluid transportation (151) has to operate at high pressure, which has two consequences; One, its unfeasible to use a pressure intensifier to increase flow rate, which in turn requires large flow for larger designs, in practice this means several devices for hydraulic fluid transportation (151) in parallel, which will increase cost; Two, a significant amount of oil will leak from the drain port of the device for hydraulic fluid transportation (151) while its pressurized, this can be countered by a secondary pump to transport it back and by using valves in the conduit device (7, 7') to disconnect the device for hydraulic fluid transportation (151) from the hydraulic pressure (not shown) when it's not in use. Main use of this design seems to be for smaller compensators, where one pump gives high enough flow, combined with valves to disconnect the hydraulic pressure.

FIG. 16 illustrates a version or embodiment of a mobile semi active heave compensator 100 where a pressure intensifier (40) is used to increase the flow rate of the device for hydraulic fluid transportation (151). The flow is increased by a factor equal to the square of the diameter ratio between the fourth piston (43) and the second piston rod (44), which can be in the range 1.1-40. The fourth piston can also be used to indirectly determine the position of the first piston (12) using a third piston position sensor (19). The compensator (100) is fitted with a device for distance measurement (39), suitable for measuring the distance to the seabed (1007), which can be helpful in improving efficiency of the compensator (100). The compensator (100) is also fitted with a device for communication (300), which is suited for communicating with the crane on the vessel (1008), mainly giving MRU readings (MRU located in crane tip) and winch speed to the compensator (100) computer so that it can react faster to operator action (i.e. spooling of wire rope) and increase efficiency. This version of the compensator (100) is well suited for large designs and applications where rapid response is required.

These embodiments will now be described in detail, referring to FIGS. 15 and 16. The mobile heave compensator 100 is normally rigged to a work wire coming from the vessel at either the second connection device (14), where the second connection device (14) is facing down, or the first connection device (14), where the first connection device (14) is facing up. The connection devices 14 not connected to the vessel are connected to the payload. If necessary or desired, any one of the connection device (14) can be connected to both the vessel and the payload. The connection devices (14 can be at least one of: a padeye and a clevis, but not limited only thereto. The first cylinder (10) contains a first piston (12). A first piston rod (13) extends from the first piston (12) located within the first cylinder (10) through the lower end thereof. The first cylinder (10) contains a first volume V1, filled with hydraulic fluid, located between the first piston (12) and the lower end of the first cylinder (10). The first cylinder (10) also contains a second volume V2, with no content (vacuum), located between the first piston (12) and the upper end of the first cylinder (10). A first piston position sensor (6) may be present in the first cylinder (10). The first piston position sensor (6) can be used to directly calculate the position of at least one of: the first piston (12) and the first piston rod (13), relative to at least one of the upper and lower ends of the first cylinder (10).

The second cylinder (60) contains a second piston (9) separating a third volume V11, filled with hydraulic fluid, located between the lower end of the second cylinder (60) and the second piston (9), as well as a fourth volume V12, filled with gas, located between the upper end of the second cylinder (60) and the second piston (9). A second piston position sensor (6') can be used to indirectly calculate the position of at least one of: the first piston (12) and the first piston rod (13), relative to at least one of the upper and lower ends of the first cylinder (10). The gas pressure in the fourth volume V12 in the second cylinder (60) effectively pressurizes the first volume V1 in the first cylinder (10) via conduit device (7) connecting the lower sides of the first (10) and the second (60) cylinder, as well as the third volume V12 in the second cylinder (60). A device for hydraulic fluid transportation (1517) is connected between the oil side of the first cylinder (10) and the oil side of the second cylinder (60). Valves may also be present in the conduit devices (7,7'), this is not shown in the figure. An energy source (16) powers the device for hydraulic fluid transportation, and may be a large battery pack or an umbilical. An accelerometer (301) and/or a pressure sensor for external pressure (not shown), combined with a position sensor (6,6') is used to control the device for hydraulic fluid transportation (17).

FIG. 16 illustrates another version or embodiment of a mobile semi active heave compensator 100. This will now be described in detail. The heave compensator (100) is normally rigged to a work wire coming from the vessel at either the second connection device (14), where the second connection device (14) is facing down, or the first connection device (14), where the first connection device (14) is facing up. The connection device (14) not connected to the vessel is connected to the payload. If necessary or desired, any one of the connection device (14) can be connected to both the vessel and the payload. The connection device (14) can be at least one of: a padeye and a clevis, but not limited only thereto. The first cylinder (10) contains a first piston (12). A first piston rod (13) extends from the first piston (12) located within the first cylinder (10) through the lower end thereof. The first cylinder (10) contains a first volume V1, filled with hydraulic fluid, located between the first piston (12) and the lower end of the first cylinder (10). The first cylinder (10) also contains a second volume V2, filled with hydraulic fluid, located between the first piston (12) and the upper end of the first cylinder (10). A first piston position sensor (6) may be present in the first cylinder (10). The first piston position sensor (6) can be used to directly calculate the position of at least one of: the first piston (12) and the first piston rod (13), relative to at least one of the upper and lower ends of the first cylinder (10).

The second cylinder (60) contains a second piston (9) separating a third volume V11, filled with hydraulic fluid, located between the lower end of the second cylinder (60) and the second piston (9), as well as a fourth volume V12, filled with gas, located between the upper end of the second cylinder (60) and the second piston (9). A second piston position sensor (6') can be used to indirectly calculate the position of at least one of: the first piston (12) and the first piston rod (13), relative to at least one of the upper and lower ends of the first cylinder (10). The gas pressure in the fourth volume V12 in the second cylinder (60) effectively pressurizes the first volume V1 in the first cylinder (10) via conduit device (7) connecting the lower sides of the first (10) and the second (60) cylinder, as well as the third volume V12 in the second cylinder (60).

The third cylinder (40) contains a third piston (44) and a fifth volume V6, filled with hydraulic fluid, located between the third piston (44) and the upper end of the third cylinder (40), as well as a sixth volume V7, filled with low pressure gas, located between the third piston (26) and the lower end of the third cylinder (40). A second piston rod (43) is connected to the third piston (44 and extends through the lower end of the third cylinder (40) into a fourth cylinder (42). The fourth cylinder (42) contains a seventh volume V8, filled with hydraulic fluid, located around the second piston rod (43) and the fourth cylinder (42). A third piston position sensor (19) may be present in the upper volume V6 of the lower volume V8. The third piston position sensor (19) can indirectly measure the position of the first piston (2). The area ratio between piston (44) and rod (43) acts like a pressure intensifier, which effectively multiplies the oil flow from the device for hydraulic fluid transportation (151). This is needed due to high required flow rate at low pressure, while commercially available reversible pumps give high pressure at low flow.

The fifth cylinder (70) contains a fourth piston (62). The fifth cylinder (70) contains an eighth volume V13, filled with gas, located between the fourth piston (72) and the lower end of the fifth cylinder (70), as well as a ninth volume V14, filled with hydraulic fluid, located between the fourth piston (72) and the upper end of the fifth cylinder (70). The gas pressure in the eighth volume V13 in the third cylinder (70) effectively pressurizes hydraulic fluid in the ninth volume V14 in the fifth cylinder (70). The fifth volume V6 is connected to the second volume V2 via conduit device (7'), and they have the same pressure.

The pressure in the hydraulic fluid in the seventh volume V8 in the fourth cylinder (40) is not necessarily equal to the pressure of the hydraulic fluid in the ninth volume V14 in the fifth cylinder (70), because the device for hydraulic fluid transportation (151) can transport hydraulic fluid between the two volumes, via conduit device (18, 18') and create a positive or a negative pressure deviation between them. Valves may also be present in the conduit device (18, 18'), this is not shown in the figure. An energy source (16) powers the device for hydraulic fluid transportation, and may be a large battery pack or an umbilical connected to the vessel. An accelerometer (301) and/or a pressure sensor for external pressure (not shown), and/or a device for distance measurement (39), and/or a device for communication (300) with the MRU located in the crane tip (not shown), combined with a position sensor (6,6') is used to control the device for hydraulic fluid transportation (151).

The gas pressures in all gas volumes may be adjusted by a device for gas transportation (not shown).

It is possible to connect multiple cylinders in parallel and series to achieve the same basic functionality (not shown).

It is also possible to control the device for hydraulic fluid transportation (151) having in mind that the net force on the payload should be constant. This can be achieved by regulating the pressure on the upper side of the first piston (12). When the pressure on the lower side of the first piston (12) increases due to gas compression, the pressure on the upper side of the first piston (12) will increase simultaneously, so that the net force will be zero.

The device for hydraulic fluid transportation (151) can be at least one reversible hydraulic pump driven by an electric motor.

The hydraulic fluid can normally be a mineral oil or a glycol-water fluid, but not limited only thereto.

Figure 18:
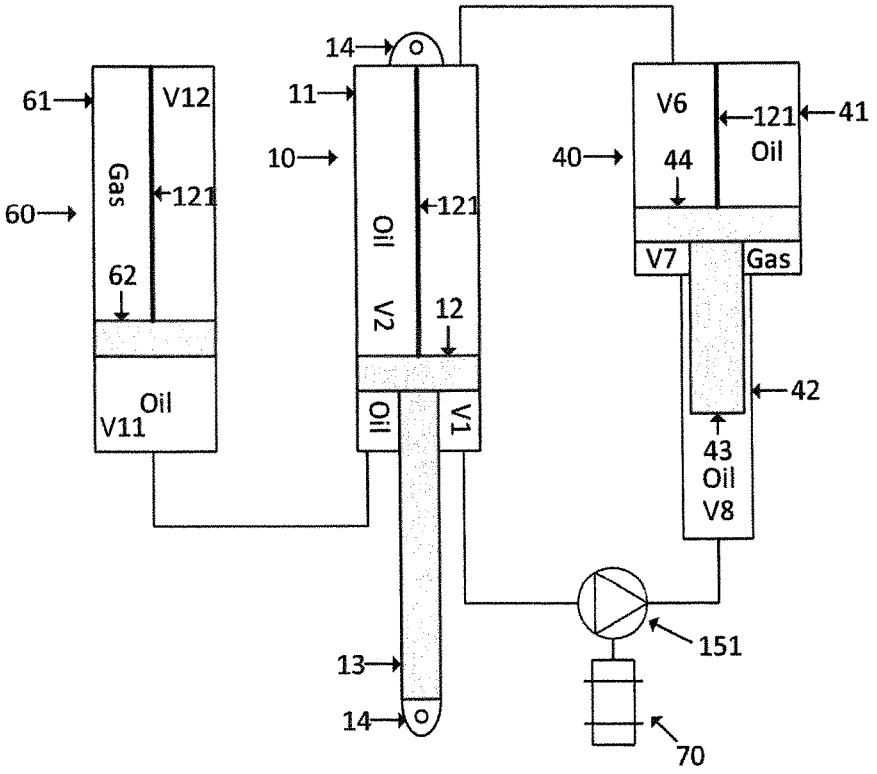
FIGS. 18 to 25 shows schematically illustrations of eight versions or embodiments of the mobile depth compensated active heat compensator (DCIAHC) according to the present invention in which the major component parts of the DCIAHC are specifically identified. The basic concept is to modify a standard passive heave compensator with an active element, in this case a pump. As most reversible pumps available on the market is low flow, high pressure pumps and the compensators need is the opposite, i.e. high flow and low pressure, a pressure intensifier (30) is used to reduce pressure and increase flow. The source of oil for the pump can either be from an accumulator or from the passive heave compensator part. Depth compensation is provided with a pressure intensifier principle, either via a ring based cylinder or a standard pressure intensifier. The ring based depth compensator has a big advantage as it can serve a dual purpose as both a depth compensator and a flow booster for the pump.

FIG. 18 illustrates a version or embodiment of a mobile depth compensated active heave compensator (100). This will now be described in detail. The compensator (100) is normally rigged to a work wire coming from the vessel at either the first connection device (14) or the second connection device (145) and to a payload at either the first connection device (14) or the second connection device (14), i.e. the compensator (100) can be used with the rod pointing down to the seafloor or upwards to the sky. The connection device 14 can be at least one of: a padeye and a clevis, but not limited only thereto. The hydraulic actuator (10) consists of a first cylinder (11) having an upper end and a lower end, a first connection device (15) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: the vessel at the sea surface and the payload, and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (20) consists of a second cylinder (21) containing a second piston (22). The first gas accumulator (20) has a third volume (V3), containing hydraulic fluid, located between the lower end of the second cylinder (21) and the second piston (22) and a fourth volume (V4), containing gas, located between the upper end of the second cylinder (21) and the second piston (22), effectively pressurizing the third volume (V3) and the first volume (V1) via conduit device. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (41) and the third piston (44), filled with gas and a seventh volume (V7), between the ends of the fourth cylinder (32), filled with oil. The device for fluid transportation (70) is connected between the first volume (V1) and the seventh volume (V8) in such a way that the pressure in the seventh volume (V8) exerted on the second piston rod (43) is converted to a lower pressure in the fifth volume (V5) via the third piston (34), the fifth volume (V6) is in fluid communication with the second volume (V2) via conduit device. A position sensor (121) is adapted for measuring the position of a piston (12, 22, 34). The device for fluid transportation (151) is controlled based on measurements from at least one position sensor (121) and at least one motion sensor (not shown) and at least one pressure sensor (not shown, to compensate water pressure effects). Adjustment of gas pressure is done via gas transportation device (not shown), which enables adjustment of gas pressure in all gas volumes.

Figure 19:
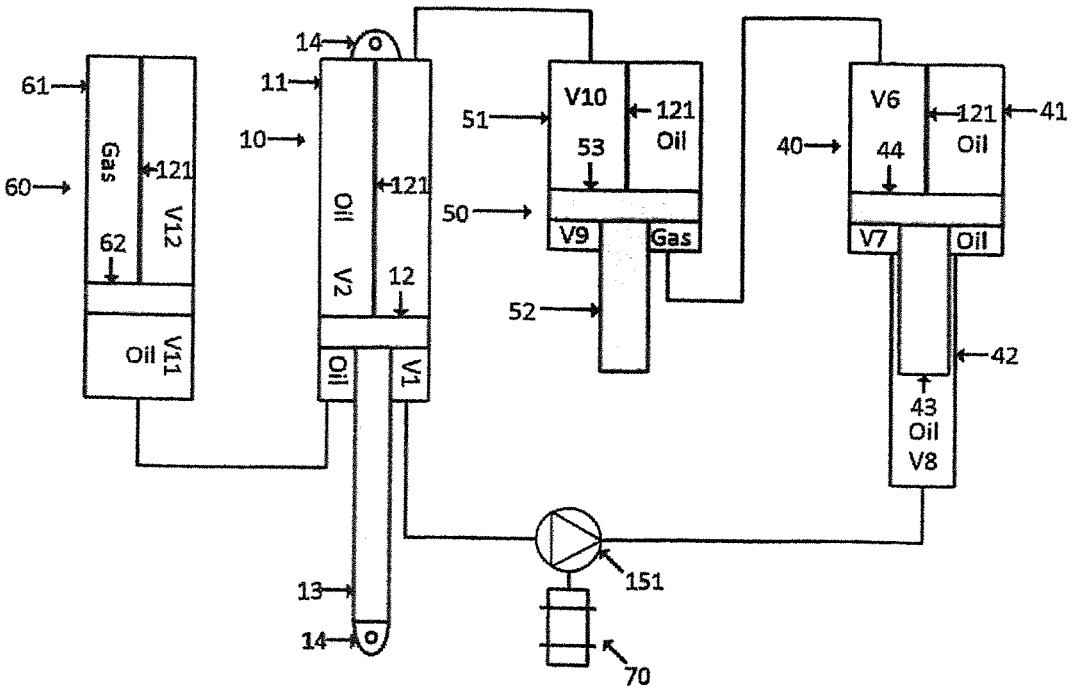

FIG. 19 illustrates another version or embodiment of a depth compensated mobile active heave compensator 100. This will now be described in detail. The compensator 100 is normally rigged to a work wire coming from the vessel at either the first connection device (14) or the second connection device (14) and to a payload at either the first connection device (14) or the second connection device (14), i.e. the compensator 100 can be used with the rod pointing down to the seafloor (103) or upwards to the sky. The connection device 14 can be at least one of: a padeye and a clevis, but not limited only thereto. The hydraulic actuator (10) consists of a first cylinder (11) having an upper end and a lower end, a first connection device (14) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: the vessel at the sea surface and the payload, and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V11), containing hydraulic fluid, located between the lower end of the second cylinder (61) and the second piston (622) and a fourth volume (V12), containing gas, located between the upper end of the second cylinder (61) and the second piston (62), effectively pressurizing the third volume (V311 and the first volume (V1) via conduit device. The depth compensator (50) consists of a fifth cylinder (51), a third piston rod (52) exposed to external pressure and a fourth piston (53), forming an eighth volume (V9) between one end of the fifth cylinder (51) and the fourth piston (53), filled with oil, a ninth volume (V10) between the other end of the fifth cylinder (51) and the fourth piston (53), filled with oil. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (41) and the third piston (44), filled with gas and a seventh volume (V8), between the ends of the fourth cylinder (42), filled with oil. A conduit device between the second volume (V2) and the ninth volume (V10) allows fluid communication between the respective volumes. A conduit device between the eighth volume (V9) and the fifth volume (V6) allows fluid communication between the respective volumes. The device for fluid transportation (151) is connected between the first volume (V1) and the seventh volume (V8) in such a way that the pressure in the seventh volume (V8) exerted on the second piston rod (43) is converted to a lower pressure in the fifth volume (V5) via the third piston (44). A position sensor (121) is adapted for measuring the position of a piston (12, 22, 44, 53, 62). The device for fluid transportation (151) is controlled based on measurements from at least one position sensor (121) and at least one externally arranged motion sensor. Adjustment of gas pressure is done via gas transportation device (not shown), which enables adjustment of gas pressure in all gas volumes.

Figure 20:
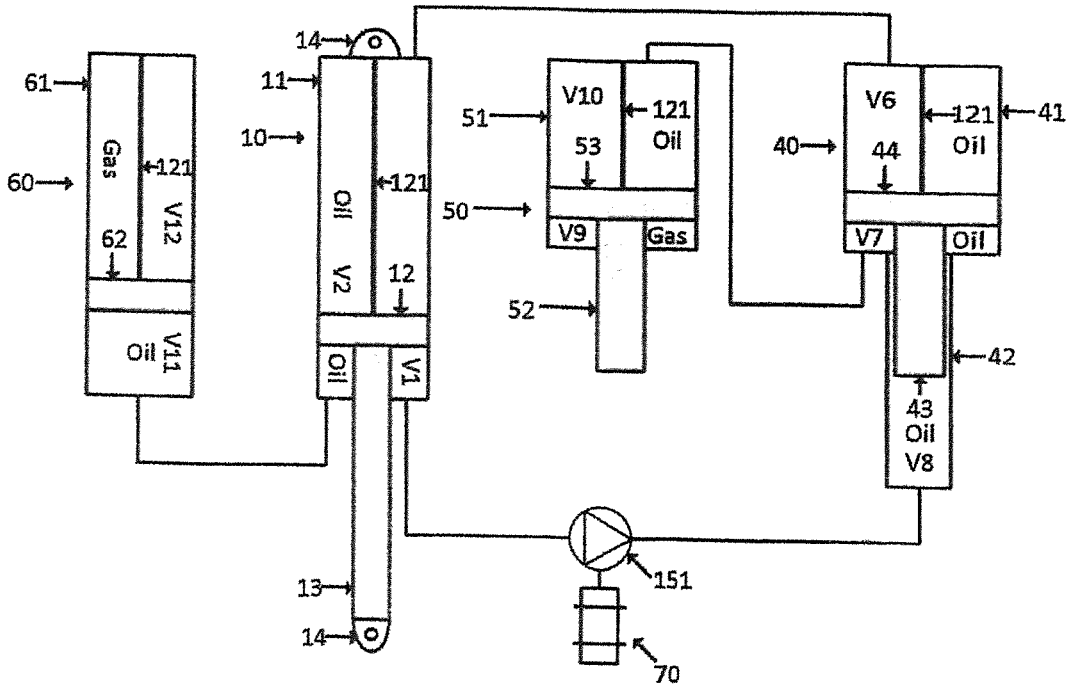

FIG. 20 illustrates a version or embodiment of a mobile depth compensated active heave compensator 100. This will now be described in detail. The compensator 100 is normally rigged to a work wire coming from the vessel at either the first connection device (14) or the second connection device (14) and to a payload at either the first connection device (14) or the second connection device (14), i.e. the compensator 100 can be used with the rod pointing down to the seafloor or upwards to the sky. The connection device 14 can be at least one of: a padeye and a clevis, but not limited only thereto. The hydraulic actuator (10) consists of a first cylinder (11) having an upper end and a lower end, a first connection device (14) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: the vessel at the sea surface and the payload, and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V112), containing hydraulic fluid, located between the lower end of the second cylinder (61) and the second piston (62) and a fourth volume (V12), containing gas, located between the upper end of the second cylinder (61) and the second piston (62), effectively pressurizing the third volume (V11) and the first volume (V1) via conduit device. The depth compensator (50) consists of a fifth cylinder (51), a third piston rod (52) exposed to external pressure and a fourth piston (53), forming an eighth volume (V9) between one end of the fifth cylinder (51) and the fourth piston (53), filled with gas, a ninth volume (V10) between the other end of the fifth cylinder (51) and the fourth piston (53), filled with oil. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (41) and the third piston (44), filled with oil and a seventh volume (V8), between the ends of the fourth cylinder (42), filled with oil. A conduit device between the second volume (V2) and the fifth volume (V6) allows fluid communication between the respective volumes. A conduit device between the ninth volume (V10) and the sixth volume (V7) allows fluid communication between the respective volumes. The device for fluid transportation (151) is connected between the first volume (V1) and the seventh volume (V8) in such a way that the pressure in the seventh volume (V8) exerted on the second piston rod (43) is converted to a lower pressure in the fifth volume (V6) via the third piston (44). A position sensor (121) is adapted for measuring the position of a piston (12, 44, 53, 62). The device for fluid transportation (151) is controlled based on measurements from at least one position sensor (121) and at least one motion sensor (105). Adjustment of gas pressure is done via gas transportation device (not shown), which enables adjustment of gas pressure in all gas volumes.

Figure 21:
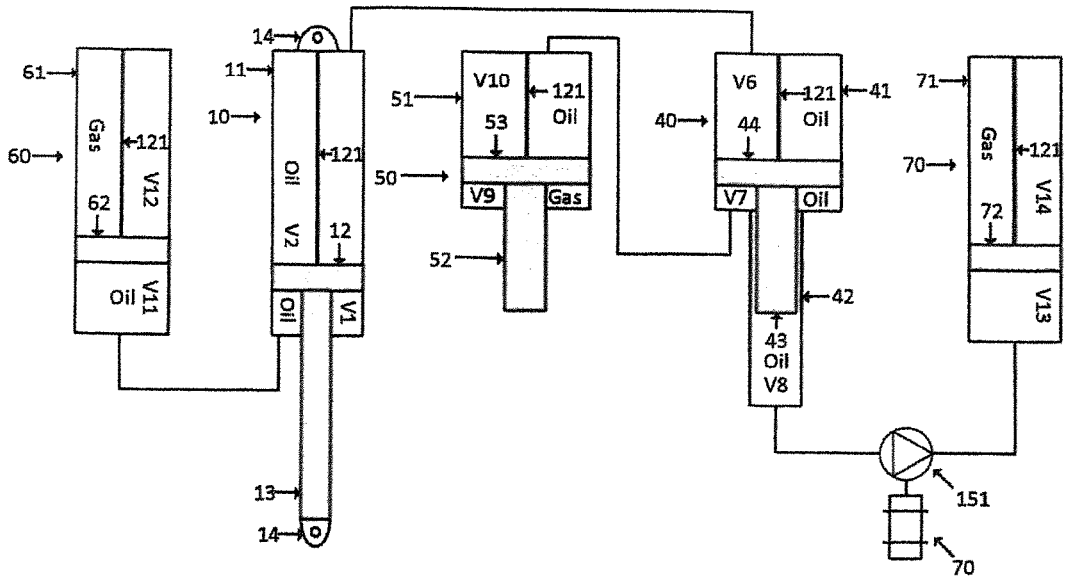

FIG. 21 illustrates yet another version or embodiment of a mobile depth compensated active heave compensator 100. This will now be described in detail. The compensator 100 is normally rigged to a work wire coming from the vessel at either the first connection device (14) or the second connection device (14) and to a payload at either the first connection device (14) or the second connection device (14), i.e. the compensator 100 can be used with the rod pointing down to the seafloor or upwards to the sky. The connection device 1 can be at least one of: a padeye and a clevis, but not limited only thereto. The hydraulic actuator (10) consists of a first cylinder (11) having an upper end and a lower end, a first connection device (14) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: a vessel at the sea surface or a payload, and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V11), containing hydraulic fluid, located between the lower end of the second cylinder (61) and the second piston (62) and a fourth volume (V12), containing gas, located between the upper end of the second cylinder (61) and the second piston (62), effectively pressurizing the third volume (V11) and the first volume (V1) via conduit device. The depth compensator (50) consists of a fifth cylinder (51), a third piston rod (52) exposed to external pressure and a fourth piston (53), forming an eighth volume (V9) between one end of the fifth cylinder (51) and the fourth piston (53), filled with gas, a ninth volume (V10) between the other end of the fifth cylinder (51) and the fourth piston (53), filled with oil. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (31) and the third piston (34), filled with oil and a seventh volume (V8), between the ends of the fourth cylinder (42), filled with oil. The second gas accumulator (70) consists of a seventh cylinder (71) and a fifth piston (72) forming a tenth volume (V13) between one end of the seventh cylinder (71) and the fifth piston (72), filled with oil, an eleventh volume (V14) between the other end of the seventh cylinder (71) and the fifth piston (72), filled with gas. A conduit device between the second volume (V2) and the fifth volume (V6) allows fluid communication between the respective volumes. A conduit device between the ninth volume (V10) and the sixth volume (V7) allows fluid communication between the respective volumes. The device for fluid transportation (1510) is connected between the tenth volume (V130) and the seventh volume (V8) in such a way that the pressure in the seventh volume (V8) exerted on the second piston rod (43) is converted to a lower pressure in the fifth volume (V6) via the third piston (44). A position sensor (121) is adapted for measuring the position of a piston (12, 44, 53, 62, 72). The device for fluid transportation (151) is controlled based on measurements from at least one position sensor (121) and at least one motion sensor (105). Adjustment of gas pressure is done via gas transportation device (not shown), which enables adjustment of gas pressure in all gas volumes.

Figure 22:
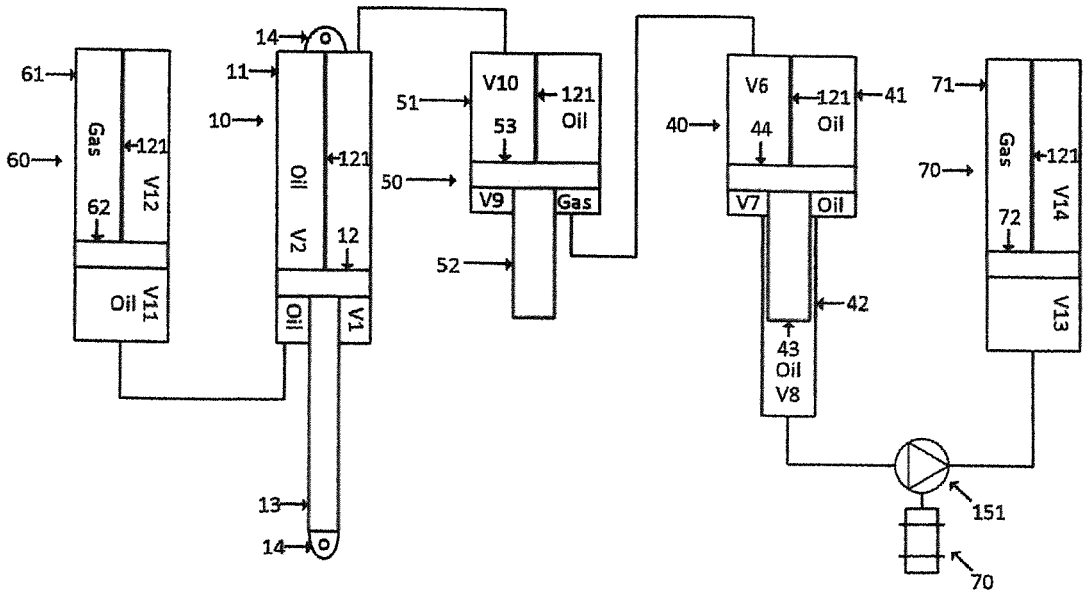

FIG. 22 illustrates a version or embodiment of a depth compensated mobile active heave compensator 100. This will now be described in detail. The compensator 100 is normally rigged to a work wire coming from the vessel (102) at either the first connection device (14) or the second connection device (14) and to a payload (101) at either the first connection device (14) or the second connection device (14), i.e. the compensator 100 can be used with the rod pointing down to the seafloor (103) or upwards to the sky. The connection device 14 can be at least one of: a padeye and a clevis, but not limited only thereto. The hydraulic actuator (10) consists of a first cylinder (11) having an upper end and a lower end, a first connection device (15) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: a vessel (102) at the sea surface or a payload (101), and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V11), containing hydraulic fluid, located between the lower end of the second cylinder (61) and the second piston (62) and a fourth volume (V12), containing gas, located between the upper end of the second cylinder (61) and the second piston (62), effectively pressurizing the third volume (V11) and the first volume (V1) via conduit device. The depth compensator (50) consists of a fifth cylinder (51), a third piston rod (52) exposed to external pressure and a fourth piston (53), forming an eighth volume (V9) between one end of the fifth cylinder (51) and the fourth piston (53), filled with oil, a ninth volume (V10) between the other end of the fifth cylinder (51) and the fourth piston (53), filled with oil. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (41) and the third piston (44), filled with gas and a seventh volume (V8), between the ends of the fourth cylinder (42), filled with oil. The second gas accumulator (70) consists of a seventh cylinder (71) and a fifth piston (72) forming a tenth volume (V13) between one end of the seventh cylinder (71) and the fifth piston (72), filled with oil, an eleventh volume (V14) between the other end of the seventh cylinder (61) and the fifth piston (62), filled with gas. A conduit device between the second volume (V2) and the ninth volume (V10) allows fluid communication between the respective volumes. A conduit device between the eighth volume (V8) and the fifth volume (V6) allows fluid communication between the respective volumes. The device for fluid transportation (1510) is connected between the tenth volume (V13) and the seventh volume (V8) in such a way that the pressure in the seventh volume (V8) exerted on the second piston rod (43) is converted to a lower pressure in the fifth volume (V6) via the third piston (44). A position sensor (121) is adapted for measuring the position of a piston (12, 44, 53, 62, 72). The device for fluid transportation (151) is controlled based on measurements from at least one position sensor (121) and at least one motion sensor (105). Adjustment of gas pressure is done via gas transportation device (not shown), which enables adjustment of gas pressure in all gas volumes.

Figure 23:
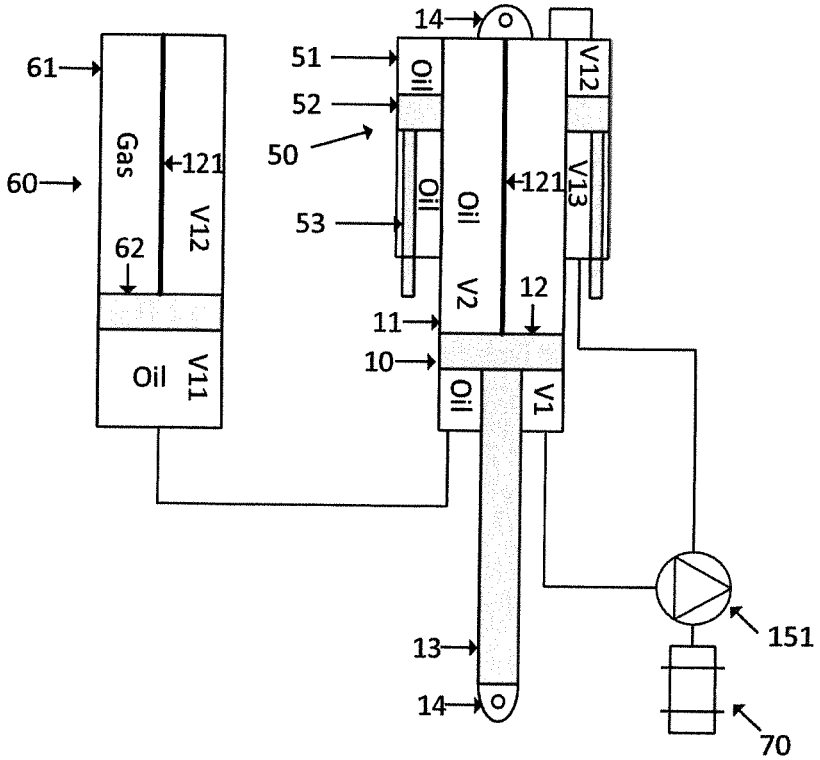

FIG. 23 illustrates a version or embodiment of a mobile depth compensated active heave compensator 100. This will now be described in detail. The compensator 100 is normally rigged to a work wire coming from the vessel (102) at either the first connection device (14) or the second connection device (14) and to a payload (101) at either the first connection device (14) or the second connection device (14), i.e. the compensator 100 can be used with the rod pointing down to the seafloor (103) or upwards to the sky. The connection device 14 can be at least one of: a padeye and a clevis, but not limited only thereto. The hydraulic actuator (10) consists of a first cylinder (11) having an upper end and a lower end, a first connection device (14) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: the vessel (102) at the sea surface and the payload (101), and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V11), containing hydraulic fluid, located between the lower end of the second cylinder (61) and the second piston (62) and a fourth volume (V12), containing gas, located between the upper end of the second cylinder (61) and the second piston (62), effectively pressurizing the third volume (V11) and the first volume (V1) via conduit device. The ring based depth compensator (50) is consists of a sixth cylinder (51), a ring piston (52), a ring piston rod (53) exposed to external pressure, forming a twelfth volume (V12) between one end of the sixth cylinder (51) and the ring piston (52), filled with oil, a thirteenth volume (V13) between the other end of the sixth cylinder (51) and the ring piston (52), the inner diameter of the ring piston rod (53) and the outer diameter of the first cylinder (11), filled with oil or gas, a fourteenth volume (V14) between the other end of the sixth cylinder (51) and the ring piston (52), the outer diameter of the ring piston rod (53) and the inner diameter of the sixth cylinder (51), filled with oil or gas. A conduit device between the second volume (V2) and the twelfth volume (V12) allows fluid communication between the respective volumes. The device for fluid transportation (70) is connected between the thirteenth volume (V13) or the fourteenth volume (V14) and the first volume (V1) in such a way that the pressure in thirteenth volume (V13) or the fourteenth volume (V14) exerted on the ring piston (52) is converted to a lower pressure in the twelfth volume (V12) via the ring piston (52). The device for fluid transportation (70) is controlled based on measurements from at least one position sensor (16, 23) and at least one motion sensor (105). Adjustment of gas pressure is done via gas transportation device (not shown), which enables adjustment of gas pressure in all gas volumes.

Figure 24:
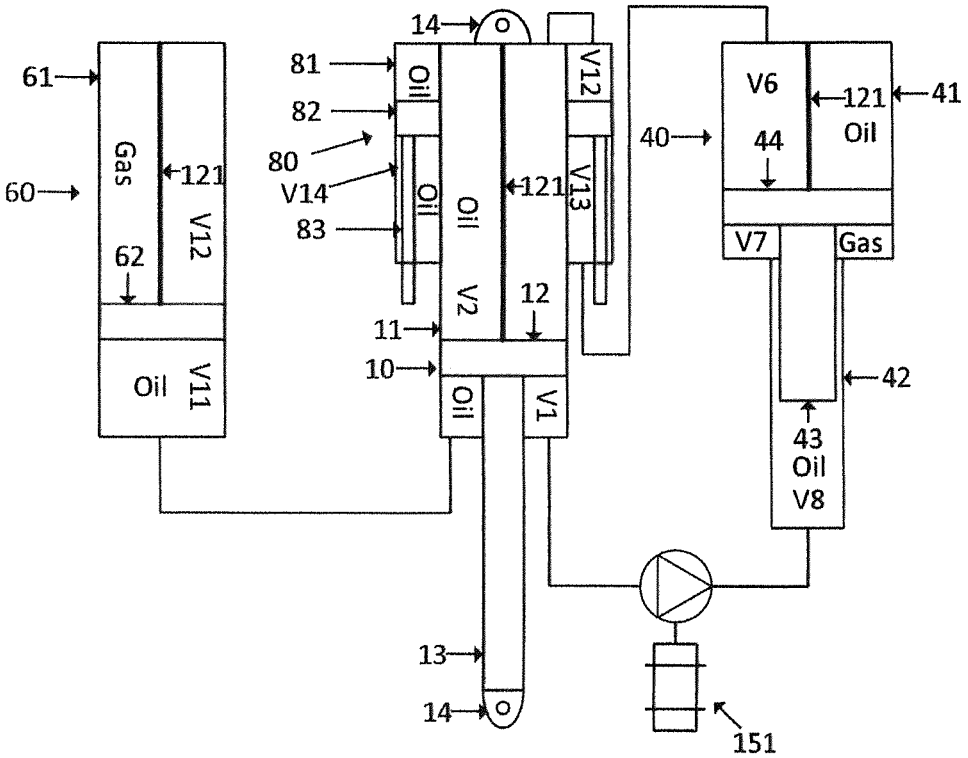

FIG. 24 illustrates a version or embodiment of a mobile depth compensated active heave compensator 100. This will now be described in detail. The compensator 100 is normally rigged to a work wire coming from the vessel (102) at either the first connection device (14) or the second connection device (14) and to a payload (101) at either the first connection device (14) or the second connection device (14), i.e. the compensator 100 can be used with the rod pointing down to the seafloor (103) or upwards to the sky. The connection device 14 can be at least one of: a padeye and a clevis, but not limited only thereto. The hydraulic actuator (10) consists of a first cylinder (11) having an upper end and a lower end, a first connection device (14) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: a vessel (102) at the sea surface or a payload (101), and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V11), containing hydraulic fluid, located between the lower end of the second cylinder (61) and the second piston (62) and a fourth volume (V12), containing gas, located between the upper end of the second cylinder (61) and the second piston (62), effectively pressurizing the third volume (V11) and the first volume (V1) via conduit device. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (41) and the third piston (44), filled with gas and a seventh volume (V8), between the ends of the fourth cylinder (82), filled with oil. The ring based depth compensator (80) consists of a sixth cylinder (81), a ring piston (82), a ring piston rod (83) exposed to external pressure, forming a twelfth volume (V12) between one end of the sixth cylinder (81) and the ring piston (82), filled with oil, a thirteenth volume (V13) between the other end of the sixth cylinder (81) and the ring piston (82), the inner diameter of the ring piston rod (83) and the outer diameter of the first cylinder (11), filled with oil or gas, a fourteenth volume (V14) between the other end of the sixth cylinder (81) and the ring piston (82), the outer diameter of the ring piston rod (83) and the inner diameter of the sixth cylinder (81), filled with oil or gas. A conduit device between the second volume (V2) and the twelfth volume (V12) allows fluid communication between the respective volumes. A conduit device between the fifth volume (V5) and the thirteenth volume (V13) or the fourteenth volume (V14) allows fluid communication between the respective volumes. The device for fluid transportation (151) is connected between the first volume (V1) and the seventh volume (V7) in such a way that the pressure in the seventh volume (V8) exerted on the second piston rod (34) is converted to a lower pressure in the fifth volume (V6) via the third piston (44). The device for fluid transportation (151) is controlled based on measurements from at least one position sensor 121 and at least one motion sensor (105). Adjustment of gas pressure is done via gas transportation device (not shown), which enables adjustment of gas pressure in all gas volumes.

Figure 25:
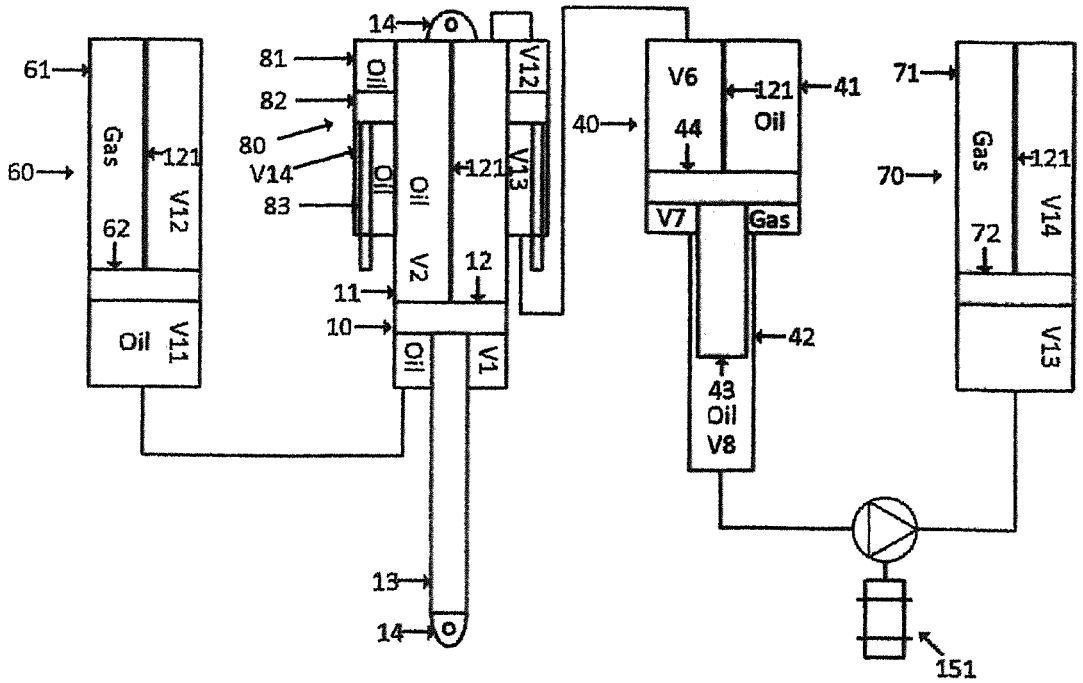

FIG. 25 illustrates a version or embodiment of a mobile depth compensated active heave compensator (100). This will now be described in detail. The compensator 100 is normally rigged to a work wire coming from the vessel (102) at either the first connection device (14) or the second connection device (14) and to a payload (101) at either the first connection device (14) or the second connection device (14), i.e. the compensator 100 can be used with the rod pointing down to the seafloor (103) or upwards to the sky. The connection device 14 can be at least one of: a padeye and a clevis, but not limited only thereto. The hydraulic actuator (10) consists of a first cylinder (11) having an upper end and a lower end, a first connection device (14) mounted at the upper end of the first cylinder (11), a first piston (12) located within the first cylinder (11) and adapted for reciprocation with respect thereto, a first piston rod (13) connected to the first piston (12) and extending downwardly therefrom through the lower end of the first cylinder (11), a second connector device (14) adapted for securing the first piston rod (13) to at least one of: a vessel (102) at the sea surface or a payload (101), and located at the lower end of the first cylinder (11). The hydraulic actuator (10) has a first volume of hydraulic fluid (V1) located between the first piston (12) and the lower end of the first cylinder (11) and a second volume of hydraulic fluid (V2) located between the first piston (12) and the upper end of the first cylinder (11). The first gas accumulator (60) consists of a second cylinder (61) containing a second piston (62). The first gas accumulator (60) has a third volume (V11), containing hydraulic fluid, located between the lower end of the second cylinder (61) and the second piston (62) and a fourth volume (V12), containing gas, located between the upper end of the second cylinder (61) and the second piston (62), effectively pressurizing the third volume (V11) and the first volume (V1) via conduit device. The pressure intensifier (40), consists of a third cylinder (41), a fourth cylinder (42), a second piston rod (43) and a third piston (44), forming a fifth volume (V6) between one end of the third cylinder (41) and the third piston (44), filled with oil, a sixth volume (V7) between the other end of the third cylinder (41) and the third piston (44), filled with gas and a seventh volume (V8), between the ends of the fourth cylinder (42), filled with oil. The ring based depth compensator (80) consists of a sixth cylinder (81), a ring piston (82), a ring piston rod (83) exposed to external pressure, forming a twelfth volume (V12) between one end of the sixth cylinder (81) and the ring piston (82), filled with oil, a thirteenth volume (V13) between the other end of the sixth cylinder (81) and the ring piston (82), the inner diameter of the ring piston rod (83) and the outer diameter of the first cylinder (11), filled with oil or gas, a fourteenth volume (V14) between the other end of the sixth cylinder (81) and the ring piston (82), the outer diameter of the ring piston rod (83) and the inner diameter of the sixth cylinder (81), filled with oil or gas. The second gas accumulator (7), consists of a seventh cylinder (71) and a fifth piston (72) forming a tenth volume (V13 between one end of the seventh cylinder (71) and the fifth piston (72), filled with oil, an eleventh volume (V14 between the other end of the seventh cylinder (71) and the fifth piston (72), filled with gas. A conduit device between the second volume (V2) and the twelfth volume (V12) allows fluid communication between the respective volumes. A conduit device between the thirteenth volume (V13) or the fourteenth volume (V14) and the fifth volume (V6), allows fluid communication between the respective volumes. The device for fluid transportation (151) is connected between the tenth volume (V13) and the seventh volume (V8) in such a way that the pressure in the seventh volume (V8) exerted on the second piston rod (43) is converted to a lower pressure in the fifth volume (V6) via the third piston (44). The device for fluid transportation 151) is controlled based on measurements from at least one position sensor (121) and at least one motion sensor (105). Adjustment of gas pressure is done via gas transportation device (not shown), which enables adjustment of gas pressure in all gas volumes.

The following section will describe how a mobile active heave compensator (100) according to the present invention works during different phases of an offshore subsea lift. It is assumed that a payload (101) is initially on a barge (103) next to an installation vessel (102), as shown in FIG. 28. This payload (101) has to be retrieved by the vessel (102). Then the payload (101) needs to cross the splash zone. Next there is a long descent of the payload (101) into deeper waters, and finally landing of the equipment (101) on a seabed (106).

There are different requirements to functionality during the different phases of the lifting operation. During the first phase, which is lifting of a payload (101) that is located a floating barge (103) from a floating vessel (101), it is beneficial if the active heave compensator (100) can compensate motion in such a way that the relative motion between the lower part of the compensator (100) and the barge (103) deck is zero. This functionality requires that three things are known:

1. Velocity of the barge deck
2 Velocity of the crane hook
3. Winch speed (i.e. wire rope spooling velocity)

The first requirement is handled by a wireless MRU (104) placed on the barge (103) deck, preferably close to the payload (101). The second requirement is either handled by an accelerometer inside the active heave compensator (100), or by a MRU (105) located on the vessel (102) or in the crane. The final requirement is normally given by the crane computer, and is transferred wirelessly to the active heave compensator (100).

Based on the information above the computer inside the active heave compensator (100) is able to control the hydraulic actuator (10) in such a way that the relative motion between the lower part of the active heave compensator (100) and the barge (103) deck is close to zero while the crane winch is not spooling out wire rope. During spooling the computer inside the active heave compensator (100) will take this into account to not cause any lag for the crane operator.

After successful connection and lifting of the payload (101) from the barge (103) deck, the payload (101) has to cross the splash zone (i.e. the border between air and sea), where different requirements apply. This phase is characterized by fast dynamics, where unpredictable forces from slamming and buoyancy occurs and is best suited for a passive heave compensator, which the active heave compensator (100) basically is. Active hydraulic actuator (10) control is turned off, stiffness and damping is adjusted to the best possible settings by use of control valves (CV). During the actual crossing of the splash zone the hydraulic actuator (10) piston rod (13) tends to move towards the inner position due to buoyancy forces acting on the payload (101). This effect is compensated by adjusting the internal gas pressure in one of the following ways:

1. Release gas to the surroundings
2. Transfer gas from the double acting gas accumulator (140) to a tank with lower pressure
3. Transfer gas from the double acting gas accumulator (140) to a tank with higher pressure by utilizing the gas booster (70).

The adjustment is performed automatically by the on-board computer based on changing piston rod (13) equilibrium position.

A certain distance after crossing the splash zone, the active heave compensator (100) will often switch to a softer setting with less damping. This is done to prevent resonance in the lifting arrangement. If the passive system alone is not enough, then the piston rod (13) can either be locked by closing control valves or actively controlled by the computer to prevent resonance.

During the transport from shallow waters to deeper waters two effects influence the equilibrium position of the piston rod (13). The first influence is that the water temperature often tends to decrease as the active heave compensator (100) is lowered into deeper waters. This affects the piston rod (13) equilibrium due to the fact that the gas pressure in all gas volumes are reduced due to lowered temperature. The active heave compensator (100) compensates this either by transferring gas under higher pressure from one of the tanks to the double acting gas accumulator (140) via control valves or from a tank under lower pressure to the double acting gas accumulator (140) via the booster (70) and control valves. The second and often most important effect is the increasing water pressure. The active heave compensator (100) comes in two versions that handles this issue in different ways:

1. The active heave compensator (100) shown in FIG. 26 has a passive depth compensator (20) that via suitable area ratios effectively cancels the water pressure effect by pressurizing the inside of the piston rod (13).
2. The active heave compensator (100) shown in FIG. 27 has an active depth compensation system that adjusts gas pressure on both sides of the first piston (12) so that the water pressure effect is cancelled. The system is controlled by the on-board computer and can in many cases provide better performance than the passive system shown in FIG. 26, however the passive system is more robust.

During the final phase of the lifting operation, which is the landing phase, the active hydraulic actuator (10) control is again activated, either by acoustic commands, water pressure triggering or by an ROV, to ensure that there is minimal relative velocity between the lower end of the active heave compensator (100) and the seabed (106). The on-board computer uses the on-board accelerometer, the piston rod (13) position sensor as well as acoustically transmitted signals from the vessel about wire rope spooling to control the hydraulic actuator (10) to a high degree of accuracy and without crane operator lag.

Figure 26:
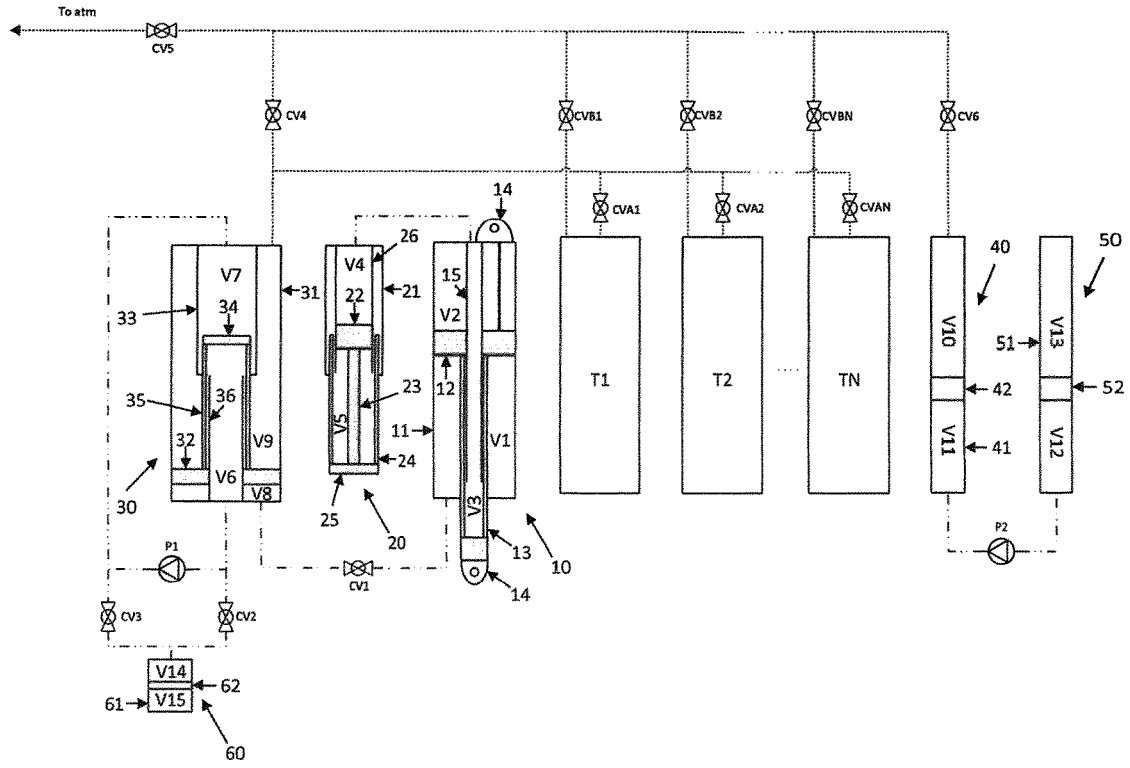
FIG. 26 shows schematically a passive depth compensated embodiment of an active heave compensator, comprising a hollow rod actuator, a double acting gas accumulator with a ring shaped piston, a passive depth compensator, two gas accumulators, and a set of tanks and two fluid transport devices.
Figure 27:
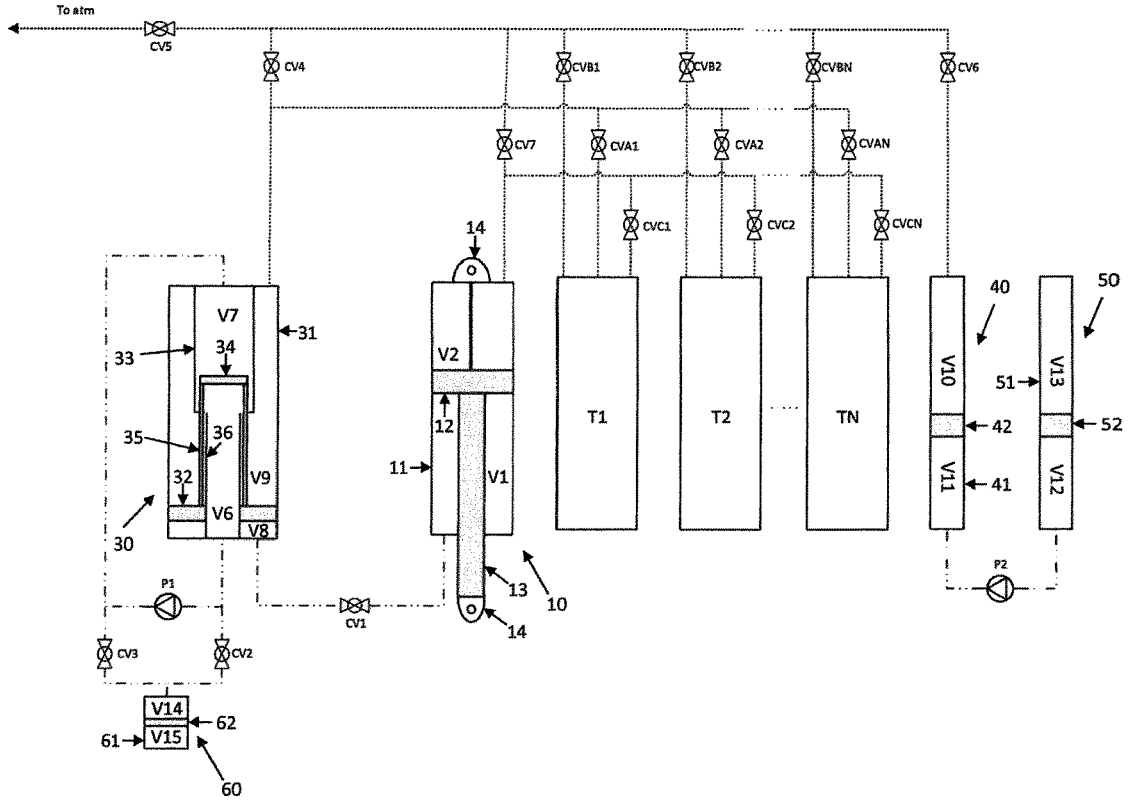
FIG. 27 shows schematically another embodiment of an active heave compensator, comprising an actuator, a double acting gas accumulator, two gas accumulators, a set of tanks and a set of fluid transportation devices.

FIG. 26 illustrates a passive depth compensated embodiment of an active heave compensator (100) with all major sub-components numbered. FIG. 27 illustrates an active depth compensated embodiment of an active heave compensator (100) with all the major-sub-components numbered.

The next section describes the common elements between the two figures, while the next two describes the particular elements of FIG. 26 and FIG. 27.

The active heave compensator (100) comprises:

- a hydraulic actuator (10), comprising of a first cylinder (1) having an upper end and a lower end, a first piston rod (13) connected to a first piston (12) and extending downwardly therefrom through the lower end of the first cylinder (11), adapted for reciprocation with respect thereto, connection device (14) mounted at the upper and lower end of the hydraulic actuator (10) adapted for connecting the active heave compensator (100) to a floating object, like a vessel (102) mounted crane, and a payload (101).
- a first volume (V1), filled with hydraulic fluid, located between the first piston (12) and the lower end of the first cylinder (11)
- a second volume (V2), filled with gas at any pressure including zero, located between the first piston (12) and the upper end of the first cylinder (11)

a double acting gas accumulator (30), comprising of a fourth cylinder (31), a ring shaped piston (32) mounted concentrically within the fourth cylinder (31) and adapted for reciprocation with respect thereto, where the lower end of the ring shaped piston (32) is on the same side as the lower end of the fourth cylinder (31) when ring shaped piston (32) is at zero stroke, a third inner cylinder (33) mounted concentrically within the fourth cylinder (31) and fixed to the upper end of the fourth cylinder (31) with a leak tight connection, a fourth inner cylinder (35) mounted concentrically inside the fourth cylinder (31) and connected to the upper end of the ring shaped piston (32) with a leak tight connection, a cylinder end (34) mounted concentrically with the fourth cylinder (31) at the upper end of the fourth inner cylinder (35) with a leak tight connection, a fifth inner cylinder (36) mounted concentrically with the fourth cylinder (31) at the lower end of the fourth cylinder (31) in a leak tight manner, where the assembly consisting of the ring shaped piston (32), the fourth inner cylinder (35) and the cylinder end (34) is adapted to reciprocate inside the fourth cylinder (31), inside the third inner cylinder (33) and outside the fifth inner cylinder (36) in a leak tight manner a sixth volume (V6), filled with hydraulic fluid, located between the cylinder end (34), the inside of the fourth inner cylinder (35), the fifth inner cylinder (36) and the lower end of the first cylinder (31)

a seventh volume (V7), filled with hydraulic fluid, located between cylinder end (34), the outside of the fourth inner cylinder (35), the inside of the third inner cylinder (33) and the upper end of the first cylinder (31)

an eighth volume (V8), filled with hydraulic fluid, located between the ring shaped piston (32), the outside of the fifth inner cylinder (36) and the lower end of the first cylinder (31)

a ninth volume (V9), filled with gas at any pressure, located between the inside the fourth cylinder (31), the upper end of the fourth cylinder (31), the outside of the third inner cylinder (33), the outside of the fourth inner cylinder (35) and the upper end of the ring shaped piston (32)

a second gas accumulator (60), consisting of a seventh cylinder (61) and a fifth piston (62), adapted for reciprocation with respect thereto a seventeenth volume (V14), filled with hydraulic fluid, located between the upper end of the seventh cylinder (61) and the upper end of the fifth piston (62)

an eighteenth volume (V15), filled with gas at any pressure, located between the lower end of the seventh cylinder (61) and the lower end of the fifth piston (62)

a conduit device between the first volume (V1) and the eighth volume (V8)

conduit device between the sixth volume (V6) and the seventh volume (V7) adapted with a first hydraulic pump (P1) adapted to transport oil under pressure between the respective volumes a conduit device between the seventeenth volume (V14) and the seventh volume (V7) adapted with a third control valve (CV3)

a conduit device between the seventeenth volume (V14) and the sixth volume (V6) adapted with a second control valve (CV2)

a sensing device adapted for measuring the position of the first piston (12)

a sensing device adapted for measuring the motion of the active heave compensator (100)

one or more sensing devices adapted for measuring the pressure in one or more volume a computer adapted for controlling the first hydraulic pump (P1) and the control valves based on input from the sensing device.

a set of tanks (T1, T2, . . . ,TN), adapted for gas storage, where the number of tanks is minimum one a set of conduit devices between each tank (T1, T2, . . . ,TN) and the ninth volume (V9), with a set of control valve devices (CVA1, CVA2, . . . ,CVAN) in each conduit device adapted for connecting each tank (T1, T2, . . . ,TN) individually to the ninth volume (V9)

a gas booster (40), consisting of a fifth cylinder (41) and third piston (42), adapted for reciprocation with respect thereto a first gas accumulator (50), consisting of a sixth cylinder (51) and fourth piston (52), adapted for reciprocation with respect thereto a tenth volume (V10), filled with gas under any pressure, located between the upper end of the fifth cylinder (41) and the upper end of the third piston (42)

an eleventh volume (V11), filled with hydraulic fluid, located between the lower end of the fifth cylinder (41) and the lower end of the third piston (42)

a twelfth volume (V12), filled with hydraulic fluid, located between the lower end of the sixth cylinder (51) and the lower end of the fourth piston (52)

a thirteenth volume (V13), filled with hydraulic fluid, located between the upper end of the sixth cylinder (51) and the upper end of the fourth piston (52)

conduit device between the eleventh volume (V11) and the twelfth volume (V12) adapted with a second hydraulic pump (P2) adapted for transporting hydraulic fluid under pressure between the respective volumes a set of conduit devices between each tank (T1, T2, . . . ,TN), the ninth volume (V9) and the surroundings, with a set of control valve devices (CV4, CV5, CV6, CVB1, CVB2, . . . ,CVBN) in each conduit device adapted for individually adjusting the pressure in all gas volumes, except the second volume (V2), the thirteenth volume (V13) and the fifteenth volume (V15)

a control valve device (CV1) in the conduit device between the first volume (V1) and the eighth volume (V8), adapted for manipulating the flow area from zero to free flow communication devices adapted to transfer signals between the vessel (102) and the active heave compensator (100), preferably with acoustic communication at least one wireless MRU (104, 105) adapted for transferring motion data to the active heave compensator (100)

either a battery pack or an umbilical for energy supply.

Wherein at least one of the components is constituted of a predetermined number of components arranged in a parallel or series connection in order to increase the effective capacity of that component of any type.

FIG. 26 particular details:

a first inner cylinder (15) is mounted concentrically inside the first cylinder (11) and connected with a leak tight connection to the upper end of the first cylinder the piston rod (13) is hollow and has a sealing surface towards the inner cylinder (15)

a third volume (V3) is formed, filled with hydraulic fluid, located inside the piston rod (13), the first inner cylinder (15) and the upper end of the first cylinder further the active heave compensator (100) comprises a depth compensator (20) consisting of a second cylinder (21), a second inner cylinder (26) mounted concentrically with the second cylinder (21), connected to the upper end of the second cylinder (21) in a leak tight fashion, a second piston (22) located inside the second inner cylinder (26), a second piston rod (23) connected to the second piston (22) and adapted for reciprocation within the second inner cylinder (26), a third cylinder (24) mounted concentrically within the second cylinder (21) and connected to the second piston rod (23) via a cylinder-rod connector (25)

an fourth volume (V4), filled with hydraulic fluid, located between the upper end of the second piston (22), the inside of the second inner cylinder (26) and the upper end of the second cylinder (21)

a fifth volume (V5), filled with gas under any pressure, located between the inside of the first cylinder (21), the inside of the third cylinder (24), the inside of the second inner cylinder (26), the lower side of the second piston (22) and the rod-cylinder connector (25)

wherein the rod-cylinder connector (25) as well as the third cylinder (24) is exposed to external pressure which will generate a higher pressure in the fourth volume (V4).

FIG. 27 particular details:

a set of conduit devices between each tank (T1, T2, . . . ,TN) and the second volume (V2), with a set of control valve devices (CVC1, CVC2, . . . ,CVCN) in each conduit device adapted for individually connecting any tank to the second volume (V2)

a set of conduit devices between each tank (T1, T2, . . . ,TN), the ninth volume (V9) and the surroundings, with a set of control valve devices (CV4, CV5, CV6, CV7, CVB1, CVB2, . . . ,CVBN) in each conduit device adapted for individually adjusting the pressure in all gas volumes, except the thirteenth volume (V13) and the fifteenth volume (V15).

The invention claimed is:

1. A mobile active heave compensator provided with a first attachment device for suspending the compensator from a load bearing device and a second attachment device for carrying a payload, the mobile active heave compensator comprising a passive heave compensation part and an active heave compensation part, and being associated with a sensor arrangement producing input signals for a control unit and a power source, wherein the compensator incorporates a hydraulic fluid pump and/or a motor device, affecting the active heave compensation part, producing output signal(s) to the hydraulic fluid pump and/or the motor device, based on input signals received from the sensor arrangement.

2. The mobile active heave compensator according to claim 1, wherein the power source and/or the control unit form an integral part of the compensator.

3. The mobile active heave compensator according to claim 2, wherein the mobile heave compensator is self-supported without an external electric or fluid connection to a surface vessel or a connection to an externally arranged high pressure unit.

4. The mobile active heave compensator according to claim 3, wherein the compensator comprises at least a first actuator and a first gas accumulator and wherein the hydraulic fluid pump directly or indirectly affects pressures appearing in the first actuator and/or the first gas accumulator.

5. The mobile active heave compensator according to claim 4, further comprising a conduit system including a by-pass line, enabling by-passing the pump and/or the motor device operating in a passive modus.

6. The mobile active heave compensator according to claim 5, wherein:

the passive heave compensation part is adapted for linear reciprocating motion;

the sensor arrangement is adapted for giving an output signal to an active element, based on payload motion and/or crane hook motion and/or vessel motion and/or crane tip motion; and the active element is adapted for manipulating the linear reciprocating motion in such a way that the motion of the payload relative to the seabed is minimized when desired;

wherein the mobile active heave compensator is connected between the crane hook and the payload.

7. The mobile active heave compensator, according to claim 6, comprising elements selected from the group of elements consisting of:

the first actuator, consisting of a first cylinder having an upper end and a lower end, a connection device mounted at the upper end of the first cylinder, a first piston located within the first cylinder and adapted for reciprocation with respect thereto, a first piston rod connected to the first piston and extending downwardly therefrom through the lower end of the first cylinder, a connector device located at the lower end of the first cylinder, a first volume located between the first piston and the lower end of the first cylinder, a second volume located between the first piston and the upper end of the first cylinder;

a depth compensator, consisting of a sixth cylinder, a fourth piston rod exposed to external pressure and a fourth piston, forming a ninth volume between one end of the sixth cylinder and the fourth piston, a tenth volume between the other end of the sixth cylinder and the fourth piston;

a second gas accumulator, consisting of an eighth cylinder and a sixth piston forming a thirteenth volume between one end of the eighth cylinder and the sixth piston, a fourteenth volume between the other end of the eighth cylinder and the sixth piston;

a double acting pressure intensifier, consisting of a twelfth cylinder mounted concentric between a thirteenth cylinder at the upper end of the twelfth cylinder and a fourteenth cylinder at the lower end of the twelfth cylinder, a seventh piston, a fifth piston rod connected to the lower end of the seventh piston and a sixth piston rod connected to the upper end of the seventh piston, forming a twenty-first volume between one end of the fourteenth cylinder and the lower end of the twelfth cylinder displaced by the fifth piston rod, a twenty-second volume between the lower end of the twelfth cylinder, the lower end of the seventh piston and the outer diameter of the fifth piston rod, a twenty-third volume between the upper end of the twelfth cylinder, the upper end of the seventh piston and the outer diameter of the sixth piston rod, a twenty-fourth volume between one end of the thirteenth cylinder and the upper end of the twelfth cylinder displaced by the sixth piston rod; and any functional combinations thereof.

8. The mobile active heave compensator according to claim 6, comprising:

the first actuator, consisting of a first cylinder having an upper end and a lower end, a connection device mounted at the upper end of the first cylinder, a first piston located within the first cylinder and adapted for reciprocation with respect thereto, a first piston rod connected to the first piston and extending downwardly therefrom through the lower end of the first cylinder, a connector device located at the lower end of the first cylinder, a first volume located between the first piston and the lower end of the first cylinder, a second volume located between the first piston and the upper end of the first cylinder, where the first volume is filled with oil and the second volume is filled with gas or is under vacuum;

at least one second gas accumulator, consisting of an eighth cylinder and a sixth piston forming a thirteenth volume between one end of the eighth cylinder and the sixth piston, a fourteenth volume between the other end of the eighth cylinder and the sixth piston, where the thirteenth volume is filled with oil and the fourteenth volume is filled with gas;

a double acting pressure intensifier, consisting of a twelfth cylinder mounted concentric between a thirteenth cylinder at the upper end of the twelfth cylinder and a fourteenth cylinder at the lower end of the twelfth cylinder, a seventh piston, a fifth piston rod connected to the lower end of the seventh piston and a sixth piston rod connected to the upper end of the seventh piston, forming a twenty-first volume between one end of the fourteenth cylinder and the lower end of the twelfth cylinder displaced by the fifth piston rod, a twenty-second volume between the lower end of the twelfth cylinder, the lower end of the seventh piston and the outer diameter of the fifth piston rod, a twenty-third volume between the upper end of the twelfth cylinder, the upper end of the seventh piston and the outer diameter of the sixth piston rod, a twenty-fourth volume between one end of the thirteenth cylinder and the upper end of the twelfth cylinder displaced by the sixth piston rod, where the twenty-fourth volume is filled with oil, the twenty-third volume is filled with gas, the twenty-second volume is filled with oil and the twenty-first volume is filled with oil;

a first conduit device connecting the twenty-second volume to the first volume;

a second conduit device connecting the twenty-fourth volume to at least one of the oil filled volumes of the at least one second gas accumulator(s);

a third conduit device connecting the twenty-first volume to at least one of the oil filled volumes of the at least one second gas accumulator(s); and a fourth conduit device connecting the twenty-first volume and the twenty-fourth volume via a device for hydraulic fluid transportation.

9. The mobile active heave compensator according to claim 6, comprising:

the first actuator, consisting of a first cylinder having an upper end and a lower end, a connection device mounted at the upper end of the first cylinder, a first piston located within the first cylinder and adapted for reciprocation with respect thereto, a first piston rod connected to the first piston and extending downwardly therefrom through the lower end of the first cylinder, a connector device located at the lower end of the first cylinder, a first volume located between the first piston and the lower end of the first cylinder, a second volume located between the first piston and the upper end of the first cylinder, where the first volume is filled with a first fill substance and the second volume is filled with a second fill substance;

a depth compensator, consisting of a sixth cylinder, a fourth piston rod exposed to external pressure and a fourth piston, forming a ninth volume between one end of the sixth cylinder and the fourth piston, a tenth volume between the other end of the sixth cylinder and the fourth piston, where the tenth volume is filled with a third fill substance, and the ninth volume is filled with a fourth fill substance;

at least one second gas accumulator, consisting of an eighth cylinder and a sixth piston forming a thirteenth volume between one end of the eighth cylinder and the sixth piston, a fourteenth volume between the other end of the eighth cylinder and the sixth piston, where the thirteenth volume is filled with a fifth fill substance and the fourteenth volume is filled with a sixth fill substance;

a double acting pressure intensifier, consisting of a twelfth cylinder mounted concentric between a thirteenth cylinder at the upper end of the twelfth cylinder and a fourteenth cylinder at the lower end of the twelfth cylinder, a seventh piston, a fifth piston rod connected to the lower end of the seventh piston and a sixth piston rod connected to the upper end of the seventh piston, forming a twenty-first volume between one end of the fourteenth cylinder and the lower end of the twelfth cylinder displaced by the fifth piston rod, a twenty-second volume between the lower end of the twelfth cylinder, the lower end of the seventh piston and the outer diameter of the fifth piston rod, a twenty-third volume between the upper end of the twelfth cylinder, the upper end of the seventh piston and the outer diameter of the sixth piston rod, a twenty-fourth volume between one end of the thirteenth cylinder and the upper end of the twelfth cylinder displaced by the sixth piston rod, where the twenty-fourth volume is filled with a seventh fill substance, the twenty-third volume is filled with an eighth fill substance, the twenty-second volume is filled with a ninth fill substance and the twenty-first volume is filled with a tenth fill substance;

a first conduit device connecting the second volume to the tenth volume;

a second conduit device connecting the twenty-second volume to the first volume;

a third conduit device connecting the twenty-fourth volume to at least one of the volumes of the at least one second gas accumulator, wherein the at least one of the volumes of the at least one second gas accumulator is filled with oil;

a fourth conduit device connecting the twenty-first volume to at least one of the volumes of the at least one second gas accumulator, wherein the at least one of the volumes of the at least one second gas accumulator is filled with oil; and a fifth conduit device connecting the twenty-first volume and the twenty-fourth volume via a device for hydraulic fluid transportation; wherein the first, second, third, fourth, fifth, sixth, seventh, eighth, ninth, and tenth fill substances are selected from the group of fill substances consisting of any fluid, oil, gas, vacuum, and combinations thereof.

10. The mobile active heave compensator according to claim 9, wherein:

the first fill substance comprises oil;

the second fill substance comprises oil;

the third fill substance comprises oil;

the fourth fill substance comprises gas or vacuum;

the fifth fill substance comprises oil;

the sixth fill substance comprises gas;
the seventh fill substance comprises oil
the eighth fill substance comprises gas;
the ninth fill substance comprises oil; and
the tenth fill substance comprises oil.

11. The mobile active heave compensator according to claim 10, wherein the effective size of any of the numbered volumes is expanded by connecting tanks or other devices to any of the numbered volumes.

12. The mobile active heave compensator according to claim 11, wherein the device for hydraulic fluid transportation is controlled based on measurements from at least one position sensor and/or one motion sensor.

13. The mobile active heave compensator according to claim 7, further comprising at least two devices for hydraulic fluid transportation.

14. The mobile active heave compensator according to claim 13, wherein any two of the numbered volumes that are adjacent in the pressure intensifier are connected together.

15. The mobile active heave compensator according to claim 14, wherein a device for gas transportation is used to transport gas between at least one of the numbered volumes and another of the numbered volumes and/or to the surroundings.

16. The mobile active heave compensator according to claim 15, wherein the sensor arrangement adapted to directly or indirectly measure the position of the first piston is further adapted for measuring the equilibrium position of the first piston and/or the first piston rod relative to the ends of the first cylinder.

17. The mobile active heave compensator according to claim 16, wherein the first gas accumulator and the second gas accumulator are replaced by a third gas accumulator comprising two volumes filled with oil and one volume filled with gas.

18. The mobile active heave compensator according to claim 5, further comprising:

a hydraulic actuator, comprising a first cylinder having an upper end and a lower end, a first piston rod connected to a first piston and extending downwardly therefrom through the lower end of the first cylinder, adapted for reciprocation with respect thereto, a connection device mounted at the upper and lower end of the hydraulic actuator adapted for connecting the active heave compensator to a floating object, and a payload;

a first volume, filled with hydraulic fluid, located between the first piston and the lower end of the first cylinder;

a second volume, filled with gas at any pressure including zero, located between the first piston and the upper end of the first cylinder;

a double acting gas accumulator, comprising a fourth cylinder, a ring shaped piston mounted concentrically within the fourth cylinder and adapted for reciprocation with respect thereto, where the lower end of the ring shaped piston is on the same side as the lower end of the fourth cylinder when the ring shaped piston is at zero stroke, a third inner cylinder mounted concentrically within the fourth cylinder and fixed to the upper end of the fourth cylinder with a leak tight connection, a fourth inner cylinder mounted concentrically inside the fourth cylinder and connected to the upper end of the ring shaped piston with a leak tight connection, a cylinder end mounted concentrically with the fourth cylinder at the upper end of the fourth inner cylinder with a leak tight connection, a fifth inner cylinder mounted concentrically with the fourth cylinder at the lower end of the fourth cylinder in a leak tight manner, where the assembly consisting of the ring shaped piston, the fourth inner cylinder and the cylinder end is adapted to reciprocate inside the fourth cylinder, inside the third inner cylinder and outside the fifth inner cylinder in a leak tight manner;

a sixth volume, filled with hydraulic fluid, located between the cylinder end, the inside of the fourth inner cylinder, the fifth inner cylinder and the lower end of the first cylinder;

a seventh volume, filled with hydraulic fluid, located between cylinder end, the outside of the fourth inner cylinder, the inside of the third inner cylinder and the upper end of the first cylinder;

an eighth volume, filled with hydraulic fluid, located between the ring shaped piston, the outside of the fifth inner cylinder and the lower end of the first cylinder;

a ninth volume, filled with gas at any pressure, located between the inside the fourth cylinder, the upper end of the fourth cylinder, the outside of the third inner cylinder, the outside of the fourth inner cylinder and the upper end of the ring shaped piston;

a second gas accumulator, consisting of a seventh cylinder and a fifth piston, adapted for reciprocation with respect thereto;

a seventeenth volume, filled with hydraulic fluid, located between the upper end of the seventh cylinder and the upper end of the fifth piston;

an eighteenth volume, filled with gas at any pressure, located between the lower end of the seventh cylinder and the lower end of the fifth piston;

a first conduit device between the first volume and the eighth volume;

a second conduit device between the sixth volume and the seventh volume, the second conduit device having a first hydraulic pump adapted to transport oil under pressure between the sixth and seventh volumes;

a third conduit device between the seventeenth volume and the seventh volume, the third conduit device having a third device control valve;

a fourth conduit device between the seventeenth volume and the sixth volume, the fourth conduit device having a second control valve;

a first sensing device adapted for measuring the position of the first piston;

a second sensing device adapted for measuring the motion of the active heave compensator;

one or more third sensing devices adapted for measuring the pressure in one or more of the numbered volumes;

a computer adapted for controlling the first hydraulic pump and the control valves based on input from the sensing devices.

19. The mobile active heave compensator according to claim 18, further comprising:

one or more tanks adapted for gas storage;

one or more fifth conduit devices between each of the one or more tanks and the ninth volume, wherein each of the one or more fifth conduit devices includes a fourth control valve device, wherein each of the one or more fifth conduit devices is adapted for connecting each of the one or more tanks individually to the ninth volume.

20. The mobile active heave compensator according to claim 19, further comprising:

a gas booster, consisting of a fifth cylinder and third piston, adapted for reciprocation with respect thereto;

a third gas accumulator, consisting of a sixth cylinder and fourth piston, adapted for reciprocation with respect thereto;

a tenth volume, filled with gas under any pressure, located between the upper end of the fifth cylinder and the upper end of the third piston;

an eleventh volume, filled with hydraulic fluid, located between the lower end of the fifth cylinder and the lower end of the third piston;

a twelfth volume, filled with hydraulic fluid, located between the lower end of the sixth cylinder and the lower end of the fourth piston;

a thirteenth volume, filled with hydraulic fluid, located between the upper end of the sixth cylinder and the upper end of the fourth piston;

a sixth conduit device between the eleventh volume and the twelfth volume adapted with a second hydraulic pump adapted for transporting hydraulic fluid under pressure between the eleventh and twelfth volumes.

21. The mobile active heave compensator according to claim 20, further comprising:

a fifth control valve device in the first conduit device between the first volume and the eighth volume, the fifth control valve device adapted for manipulating the flow area from zero to free flow.

22. The mobile active heave compensator according to claim 21, further comprising:

the one or more fifth conduit devices between each of the one or more tanks and the ninth volume further disposed between each of the one or more tanks and the surroundings, the fourth control valve device disposed in each of the one or more fifth conduit devices and adapted for individually adjusting the pressure in the numbered volumes excluding the second volume, the thirteenth volume and the fifteenth volume.

23. The mobile active heave compensator according to claim 22, further comprising:

one or more sixth conduit devices between each of the one or more tanks and the second volume, one or more fifth control valve devices disposed in each of the one or more sixth conduit devices and adapted for individually connecting any of the one or more tanks to the second volume;

the one or more fifth conduit devices between each of the one or more tanks, the ninth volume and the surroundings, the fourth control valve device disposed in each of the one or more fifth conduit devices and adapted for individually adjusting the pressure in the numbered volumes, excluding the thirteenth volume and the fifteenth volume.

24. The mobile active heave compensator according to claim 23, wherein a first inner cylinder is mounted concentrically inside the first cylinder and connected with a leak tight connection to the upper end of the first cylinder;

the first piston rod is hollow and has a sealing surface facing the first inner cylinder;

a third volume is formed, filled with hydraulic fluid, located inside the first piston rod, the first inner cylinder and the upper end of the first cylinder; wherein the mobile active heave compensator further comprises:

a depth compensator consisting of a second cylinder, a second inner cylinder mounted concentrically within the second cylinder, connected to the upper end of the second cylinder in a leak tight fashion, a second piston located inside the second inner cylinder, a second piston rod connected to the second piston and adapted for reciprocation within the second inner cylinder, a third cylinder mounted concentrically within the second cylinder and connected to the second piston rod via a cylinder-rod connector;

a fourth volume, filled with hydraulic fluid, located between the upper end of the second piston, the inside of the second inner cylinder and the upper end of the second cylinder; and a fifth volume, filled with gas under any pressure, located between the inside of the first cylinder, the inside of the third cylinder, the inside of the second inner cylinder, the lower side of the second piston and the rod-cylinder connector;

wherein the rod-cylinder connector and the third cylinder are exposed to external pressure which will generate a higher pressure in the fourth volume.

25. The mobile active heave compensator according to claim 18, further comprising:

a communication device adapted to transfer signals between the vessel and the mobile active heave compensator, wherein the communication device utilizes acoustic communication.

26. The mobile active heave compensator according to claim 18, further comprising:

at least one wireless MRU adapted for transferring motion data to the active heave compensator.

27. The mobile active heave compensator according to claim 18, wherein the mobile active heave compensator is powered by a battery pack or by power delivered through an umbilical.

* * * * *